United States Patent [19]

Takeuchi et al.

[11] Patent Number: 4,782,004

[45] Date of Patent: Nov. 1, 1988

[54] METHOD FOR DEVELOPING A HEAT-DEVELOPABLE PHOTOSENSITIVE MATERIAL COMPRISING A DYE PROVIDING COMPOUNDS AND AN AUXILIARY DEVELOPING AGENT

[75] Inventors: Masashi Takeuchi; Kozo Sato; Hiroyuki Hirai, all of Kanagawa, Japan

[73] Assignee: Fuji Photo Film Co., Ltd., Kanagawa, Japan

[21] Appl. No.: 931,092

[22] Filed: Nov. 17, 1986

[30] Foreign Application Priority Data

Nov. 16, 1985 [JP] Japan ..... 60-258398
Apr. 18, 1986 [JP] Japan ..... 61-89808
Jul. 2, 1986 [JP] Japan ..... 61-155594

[51] Int. Cl.[4] ..... G03C 5/54
[52] U.S. Cl. ..... 430/203; 430/214; 430/617; 430/619; 430/559; 430/551
[58] Field of Search ..... 430/203, 214, 617, 619, 430/559, 551

[56] References Cited

U.S. PATENT DOCUMENTS 4,360,581 11/1982 Odenwälder et al. ..... 430/218
4,430,415 2/1984 Aono et al. ..... 430/203
4,463,079 7/1984 Naito et al. ..... 430/203
4,500,626 2/1985 Naito et al. ..... 430/559

FOREIGN PATENT DOCUMENTS 3508788 9/1985 Fed. Rep. of Germany ..... 430/559

OTHER PUBLICATIONS

Research Disclosure 17842, Gutierrez et al., "Scavenger Compounds," Feb. 1979, pp.94–97.

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A heat-developable photosensitive material comprising at lesat (1) a photosensitive silver halide, (2) a binder, (3) a dye-providing substance, and (4) a specific reducing agent other than commonly used reducing agents for silver halide on a support can be heat developed to produce images having a high density and less fog and has improved shelf stability.

3 Claims, No Drawings

METHOD FOR DEVELOPING A HEAT-DEVELOPABLE PHOTOSENSITIVE MATERIAL COMPRISING A DYE PROVIDING COMPOUNDS AND AN AUXILIARY DEVELOPING AGENT

BACKGROUND OF THE INVENTION

This invention relates to novel photosensitive materials having improved developing performance and shelf stability, and more particularly, to novel heat-developable photosensitive materials having improved developing performance and shelf stability.

Photographic processes using silver halides have been most widely used because of their superior photographic characteristics such as sensitivity and gradation control as compared with other photographic processes including electrophotography and diazo processes. A recent innovation in the process for treating a silver halide-based photosensitive material for image formation is the development of a new dry treatment technique capable of readily and quickly producing images by heating as a substitute for the conventional wet technique using developing solution.

Heat developable photosensitive materials and their image forming processes are well known in the art and described in the literature, inter alia, "Fundamentals of Photographic Engineering—Non-Silver Salt Photography—", Corona Publishing K.K., Tokyo, Japan (1982), pages 242–255; "Image Information", April 1978, page 40; and Nebletts Handbook of Photography and Reprography, 7th ed. Van Nostrand Reinhold Company, pages 32–33; U.S. Pat. Nos. 3,152,904, 3,301,678, 3,392,020, and 3,457,075; British Pat. Nos. 1,131,108 and 1,167,777; and Research Disclosure, June 1978, pages 9–15 (RD 17029).

A number of methods have been proposed for producing color images through heat development. For example, a process for forming color images through reaction of an oxidant of a developing agent with a coupler is known, U.S. Pat. No. 3,531,286 disclosing p-phenylene diamine reducing agents and phenolic or active methylene couplers; U.S. Pat. No. 3,761,270 disclosing p-aminophenol reducing agents; Belgian Pat. No. 802,519 and Research Disclosure, September 1975, pages 31–32, disclosing sulfonamide phenol reducing agents; and U.S. Pat. No. 4,021,240 disclosing a combination of a sulfonamide phenol reducing agent and a four equivalent coupler.

These processes, however, have the drawback that color images become turbid as images of reduced silver and color images are concurrently created in exposed areas after heat development. Typical solutions to this problem are by removing silver images by liquid treatment and by transferring only the dye to another layer, for example, an image-receiving layer on another sheet. It is, however, very difficult to distinguish unreacted reagents and the dye to enable the transfer of the dye only. Furthermore, the above-mentioned processes generally take a relatively long time in development and produce images having relatively high fog and low density.

A new type of image forming process using silver halide was developed to overcome these drawbacks, the process comprising imagewise forming a mobile dye and transferring the dye to a dye-fixing layer (see Japanese Patent Application Kokai Nos. 58-149046, 59-154445, 59-165054, and 59-180548, U.S. Pat. Nos. 4,503,137, 4,474,867, 4,483,914, and 4,455,363). These processes use a photosensitive material comprising a silver halide and a dye-providing substance which acts on the silver halide as a reducing agent at elevated temperatures and is itself oxidized to release a mobile dye. The material is heated in the substantial absence of water during or after exposure to light, thereby forming a mobile dye imagewise.

The image forming process of this type requires at least two steps, a step of forming a mobile dye imagewise by heating and a step of transferring the dye to a dye-fixing layer. As it is desirable to make the treatment more quick and simple, an image forming process capable of carrying out these two steps at the same time is proposed (see Japanese Patent Application Kokai No. 59-218443).

In general, these image forming processes use a reducing agent other than the common reducing agents (assigned to react with the silver halide as mentioned above) for the purposes of accelerating reaction of silver halide with a common reducing agent, preventing an oxidant of a common reducing agent from migrating to any layer other than the destined to give rise to color mixing, suppressing air oxidation of any compounds in the photosensitive material, and preventing fogging. Exemplary compounds effective as such secondary reducing agents are hydroquinone, alkyl-substituted hydroquinones such as t-butylhydroquinone and 2,5-dimethylhydroquinone, catechols, pyrogallols, halogen-substituted hydroquinones such as chlorohydroquinone and dichlorohydroquinone, alkoxy-substituted hydroquinones such as methoxyhydroquinone, and polyhydroxybenzene derivatives such as methylhydroxynaphthalene. Also effective are methyl oleate, ascorbic acid, ascorbic acid derivatives, hydroxylamines such as N,N'-di-(2-ethoxyethyl)hydroxylamine, pyrazolidones such as 1-phenyl-3-pyrazolidone, 4-methyl-4-hydroxymethyl-1-phenyl-3-pyrazolidone, reductones, and hydroxytetronic acids.

If these reducing agents are directly added to photosensitive materials, they tend to deteriorate the shelf stability of photosensitive material, lower their development accelerating effect with a lapse of time, and cause fogging. Thus the reducing agent is usually kept isolated from an emulsion layer until the time of development treatment, for example, by adding the agent to a developing solution.

It would advantageously provide a more quick and simple development treatment if a reducing agent having aging resistance can be directly incorporated in the photosensitive material, specifically in an emulsion layer or the like.

SUMMARY OF THE INVENTION

Therefore, an object of the present invention is to provide a novel and improved heat-developable photosensitive material which can produce a dye image having a high density, less fog, less color turbidity, and high color reproducibility through heat development within a short time while maintaining a substantial shelf stability.

According to the present invention, there is provided a heat-developable photosensitive material comprising on a support at least (1) a photosensitive silver halide, (2) a binder, (3) a dye-providing substance, and (4) a member selected from the group consisting of compounds having the general formulas (I) and (II):

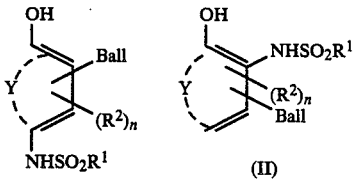

(I) (II)

wherein

Ball represents an organic ballast radical capable of rendering the compounds of these formulas non-diffusible, with the proviso that Ball may be absent when $R^1$ is a non-diffusible radical;

Y represents a group of carbon atoms necessary to complete a benzene or naphthalene nucleus;

$R^1$ is a member having no photographic influence and selected from the group consisting of a substituted or unsubstituted alkyl, cycloalkyl, aralkyl, aryl, amino, and heterocyclic radical;

$R^2$ is selected from the group consisting of hydrogen, a halogen atom, a cyano radical, a substituted or unsubstituted alkyl, cycloalkyl, aralkyl, aryl, heterocyclic, alkoxy, aryloxy, acyl, acyloxy, alkyloxycarbonyl, aryloxycarbonyl, carbamoyl, sulfamoyl, alkylsulfonyl, arylsulfonyl, acylamino, alkylthio, and arylthio radical; and n is an integer having a value of 0 to 5;

wherein when n is 2 to 5, a corresponding plurality of $R^2$ may be the same or different and may be combined together to form a ring, and when Y represents a group of carbon atoms necessary to complete a naphthalene nucleus, Ball and $R^2$ may be attached to either of the thus formed rings;

and high molecular weight compounds comprising monomer units represented by the general formula (III):

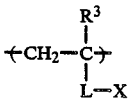

(III)

wherein $R^3$ is selected from the group consisting of hydrogen, halogen, and a lower alkyl radical;

L represents a single bond or a divalent linkage; and

X is a residue of compounds having the general formulas (IV) and (V):

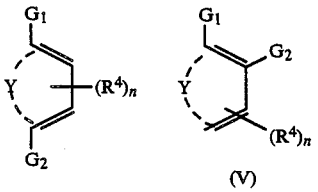

(IV) (V)

wherein

Y represents a group of carbon atoms necessary to complete a benzene or naphthalene nucleus;

G1 and G2 are independently selected from a hydroxyl radical and a sulfonylamino radical having the general formula (VI):

$$-NHSO_2R^5 \quad (VI)$$

wherein $R^5$ is a monovalent radical selected from the group consisting of a substituted or unsubstituted alkyl, cycloalkyl, aralkyl, aryl, amino, and heterocyclic radical, and $R^5$ is a divalent radical selected from the same radicals when $R^5$ is further attached to L; G1 and G2 may be the same or different;

$R^4$ is a monovalent radical selected from the group consisting of hydrogen, a halogen atom, a hydroxyl radical, a cyano radical, a substituted or unsubstituted alkyl, cycloalkyl, aralkyl, aryl, heterocyclic, alkoxy, aryloxy, acyl, acyloxy, alkyloxycarbonyl, aryloxycarbonyl, carbamoyl, sulfamoyl, alkylsulfonyl, arylsulfonyl, acylamino, alkylthio, arylthio, and amino radical, and a sulfonylamino radical having general formula (VI), and $R^4$ is a divalent radical selected from the same radicals except the former four radicals or a single bond when $R^4$ is further attached to L; and n is an integer having a value of 0 to 5;

wherein when n is 2 to 5, a corresponding plurality of $R^4$ may be the same or different and may be combined together to form a ring; and when Y represents a group of carbon atoms necessary to complete a naphthalene nucleus, $R^4$ may be attached to either of the thus formed rings;

L being attached to the X residue at either $R^4$ or $R^5$.

In one preferred embodiment, the dye-providing substance (3) is a non-diffusible, oxidizable substance which conforms to the general formula (A):

$$Ra\text{-}x\text{-}D \quad (A)$$

wherein

Ra represents a reducing substrate capable of being oxidized with the silver halide;

D is an image forming dye moiety; and x is a single bond or a linkage;

and which in oxidized form, can release a diffusible dye under alkaline developing conditions.

DETAILED DESCRIPTION OF THE INVENTION

According to a first embodiment of the present invention, the heat-developable photosensitive material comprising on a support at least (1) a photosensitive silver halide, (2) a binder, and (3) a dye-providing substance further contains (4) a compound having the general formula (I) or (II):

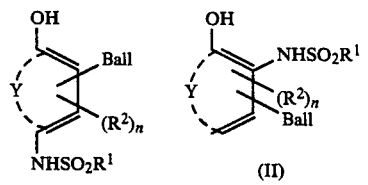

(I) (II)

In formulas (I) and (II), $R^1$ is inert from a photographic aspect and represents a radical of the type whose presence in a photographic layer does not adversely affect the quality of the resultant photograph. Illustratively, $R^1$ is a member free of photographic influence selected from a substituted or unsubstituted alkyl, cycloalkyl, aralkyl, aryl, amino, and heterocyclic radical. Preferred, nonlimiting examples of $R^1$ radicals include substituted or unsubstituted alkyl radicals having 1 to 30 carbon atoms, such as methyl, ethyl, and dodecyl; substituted or unsubstituted cycloalkyl radicals having 5 to 30 carbon atoms, such as cyclohexyl; substituted or unsubstituted aralkyl radicals having 7 to 30 carbon atoms, such as benzyl and β-phenetyl; substituted or unsubstituted aryl radicals having 6 to 30 carbon atoms, such as phenyl, naphthyl, tolyl, and xylyl; substituted or unsubstituted amino radicals having 0 to 30 carbon atoms, such as amino, methylamino, isopropylamino, cyclohexylamino, phenylamino, benzylamino, N,N-dimethylamino, N-methyl-N-ethylamino, N,N-diisopropylamino, N,N-dicyclohexylamino, N,N-diphenylamino, and N,N-dibenzylamino; and substituted or unsubstituted heterocyclic radicals such as pyridyl, furyl, and thienyl radicals.

Better performance is obtained when $R^1$ is a substituted or unsubstituted alkyl radical having 1 to 30 carbon atoms, such as methyl, ethyl, and dodecyl; a substituted or unsubstituted cycloalkyl having 5 to 30 carbon atoms, such as cyclohexyl; substituted or unsubstituted aralkyl radicals having 7 to 30 carbon atoms, such as benzyl and β-phenetyl; substituted or unsubstituted aryl radicals having 6 to 30 carbon atoms, such as phenyl and naphthyl.

The substituents on the alkyl and cycloalkyl radicals represented by $R^1$ which have no photographic influence include halogen atoms such as chloro and bromo, alkoxy, aryloxy, cyano, hydroxyl, alkoxycarbonyl, aryloxycarbonyl, amino, alkyl- or aryl-substituted amino, alkylsulfonyl, alkylsulfonylamino, arylsulfonylamino, carbamoyl, alkyl- or aryl-substituted carbamoyl, sulfamoyl, alkyl- or aryl-substituted sulfamoyl, acyl, acylamino, sulfone, carboxyl, and acyloxy radicals.

The substituents on the aralkyl and aryl radicals represented by $R^1$ which have no photographic influence include halogen atoms such as chloro and bromo, cyano, alkyl, cycloalkyl, aralkyl, aryl, alkoxy, aryloxy, alkoxycarbonyl, aryloxycarbonyl, amino, alkyl- or aryl-substituted amino, alkylsulfonyl, arylsulfonyl, alkylsulfonylamino, arylsulfonylamino, carbamoyl, alkyl- or aryl-substituted carbamoyl, sulfamoyl, alkyl- or aryl-substituted sulfamoyl, acyl, acylamino, sulfone, carboxy, hydroxyl, and acyloxy radicals.

Preferably, $R^1$ provides a pale color and is more preferably of colorless nature.

$R^2$ represents hydrogen, halogen, cyano, a substituted or unsubstituted alkyl, cycloalkyl, aralkyl, aryl, heterocyclic, alkoxy, aryloxy, acyl, acyloxy, alkyloxycarbonyl, aryloxycarbonyl, carbamoyl, sulfamoyl, alkylsulfonyl, arylsulfonyl, acylamino, alkylthio, or arylthio radical.

Preferred, non-limiting examples of $R^2$ radicals include hydrogen atom; halogen atoms such as chloro and bromo; cyano; substituted or unsubstituted alkyl radicals having 1 to 20 carbon atoms, such as methyl, ethyl, isopropyl, and t-butyl; substituted or unsubstituted cycloalkyl radicals having 5 to 20 carbon atoms, such as cyclopentyl and cyclohexyl; substituted or unsubstituted aralkyl radicals having 7 to 20 carbon atoms, such as benzyl and β-phenetyl; substituted or unsubstituted aryl radicals having 6 to 20 carbon atoms, such as phenyl, naphthyl, tolyl, and xylyl; substituted or unsubstituted heterocyclic radicals such as pyridyl, furyl, and thienyl; substituted or unsubstituted alkoxy radicals having 1 to 20 carbon atoms, such as methoxy, butoxy, and methoxyethoxy; substituted or unsubstituted aryloxy radicals having 6 to 20 carbon atoms, such as phenoxy; substituted or unsubstituted acyl radicals having 1 to 20 carbon atoms, such as acetyl and palmitoyl; substituted or unsubstituted acyloxy radicals having 1 to 20 carbon atoms, such as acetoxy; substituted or unsubstituted alkyloxycarbonyl radicals having 1 to 20 carbon atoms, such as methoxycarbonyl; substituted or unsubstituted aryloxycarbonyl radicals having 1 to 20 carbon atoms, such as phenoxycarbonyl; substituted or unsubstituted carbamoyl radicals having 1 to 20 carbon atoms, such as methylcarbamoyl, dimethylcarbamoyl, and diisopropylcarbamoyl; substituted or unsubstituted sulfamoyl radicals having 1 to 20 carbon atoms, such as dimethylsulfamoyl; substituted or unsubstituted alkylsulfonyl radicals having 1 to 20 carbon atoms, such as methylsulfonyl; substituted or unsubstituted arylsulfonyl radicals having 1 to 20 carbon atoms, such as phenylsulfonyl and p-methylphenylsulfonyl; substituted or unsubstituted acylamino radicals having 2 to 20 carbon atoms, such as acetylamino, N-methylacetylamino, and palmitoylamino; substituted or unsubstituted alkylthio radicals having 1 to 20 carbon atoms, such as methylthio and ethylthio; and substituted or unsubstituted arylthio radicals having 6 to 30 carbon atoms, such as phenylthio and m-methoxycarbonylphenylthio radicals.

The letter n is an integer having a value of 0 to 5. When n is 2 to 5, a corresponding plurality of $R^2$ may be the same or different. They may be combined together to form a ring. Examples of the ring formed by plural $R^2$ are cyclohexene and bicyclo[2.2.1]hept-2-ene fused to the benzene ring completed by Y as will be described later.

Ball represents an organic ballast radical capable of rendering the compounds of these formulas non-diffusible, with the proviso that Ball may be absent when $R^1$ is a non-diffusible radical.

The nature of the ballast radical represented by Ball is not critical insofar as the ballast radical imparts diffusion resistance to the associated compound. The useful ballast radicals contain at least 8 carbon atoms, and include, for example, substituted or unsubstituted alkyl radicals having 8 to 30 carbon atoms, substituted or unsubstituted amide radicals having 8 to 30 carbon atoms, keto radicals having 8 to 30 carbon atoms, substituted or unsubstituted alkoxy radicals having 8 to 30 carbon atoms, substituted or unsubstituted alkylthio radicals having 8 to 30 carbon atoms, substituted or unsubstituted alkyl- or arylsulfonyl radicals having 8 to 30 carbon atoms, substituted or unsubstituted acyloxy radicals having 8 to 30 carbon atoms, substituted or unsubstituted amino radicals having 8 to 30 carbon atoms, substituted or unsubstituted carbamoyl radicals having 8 to 30 carbon atoms, and substituted or unsubstituted sulfamoyl radicals having 8 to 30 carbon atoms.

Y represents a group of carbon atoms necessary to complete a benzene or naphthalene nucleus. When Y represents a group of carbon atoms necessary to complete a naphthalene nucleus, Ball and $R^2$ may be attached to either of the thus formed rings. The compounds of the present invention wherein Y completes a naphthalene nucleus are of the structure exhibiting the best performance.

Some preferred, but non-limiting, examples of the compounds having general formulas (I) and (II) are given below.

(1)
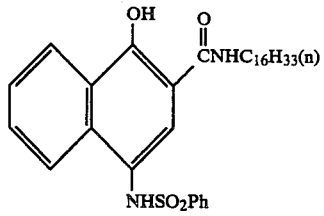
(2)
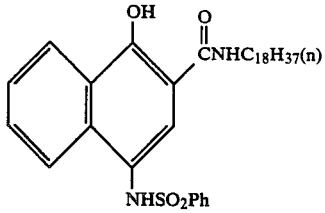
(3)
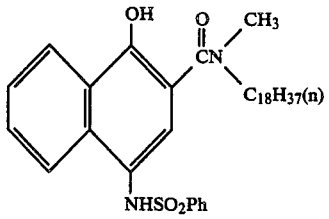
(4)
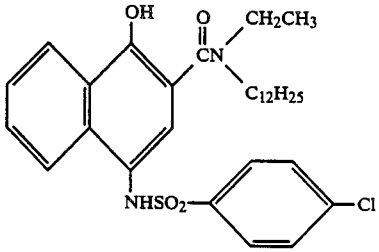
(5)
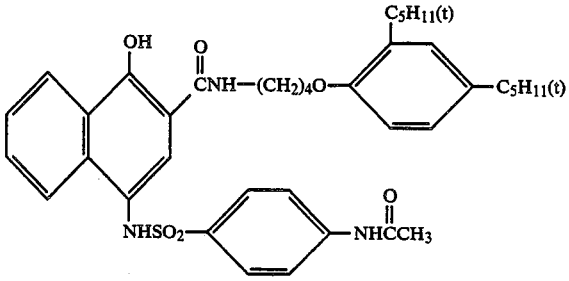
(6)
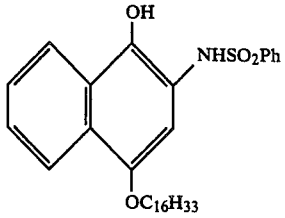
(7)
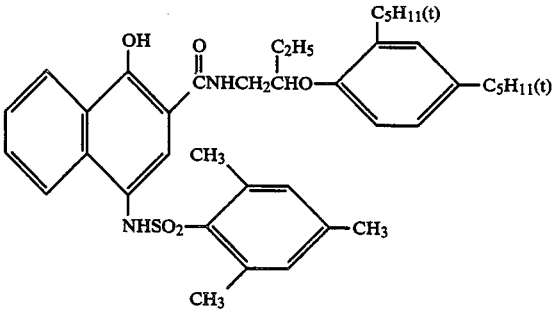
(8)
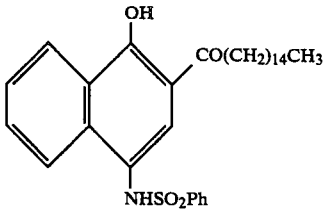
(9)
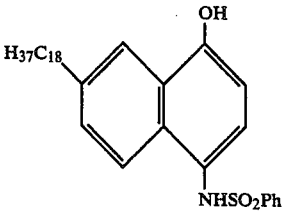
(10)
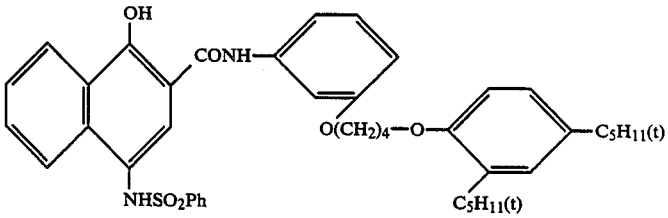
(11)
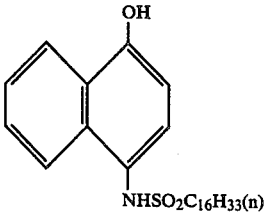
(12)
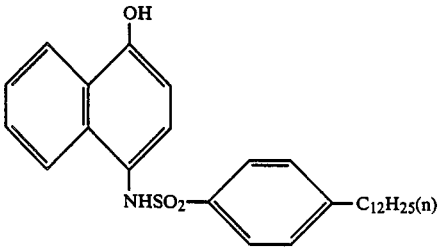

-continued
(13)
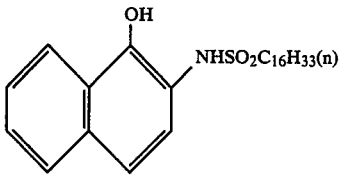
(14)
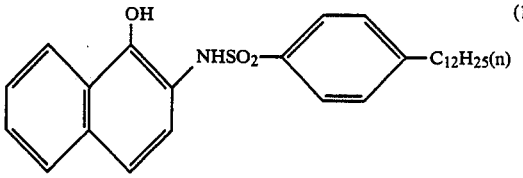
(15)
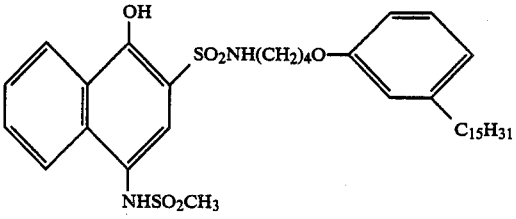
(16)
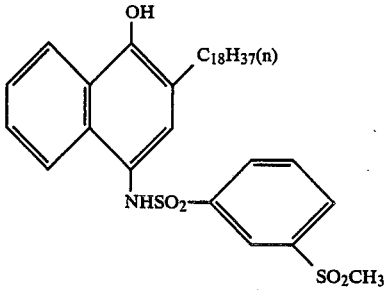
(17)
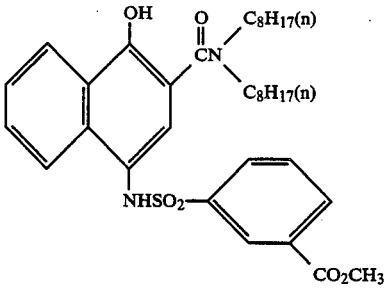
(18)
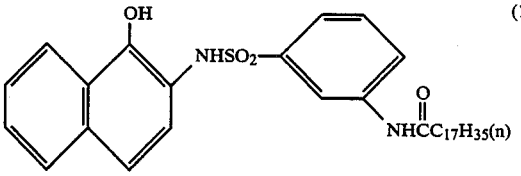
(19)
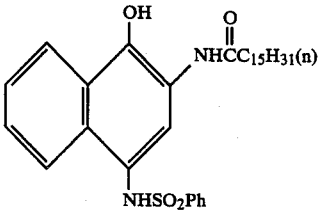
(20)
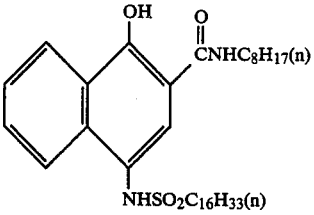
(21)
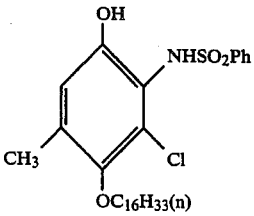
(22)
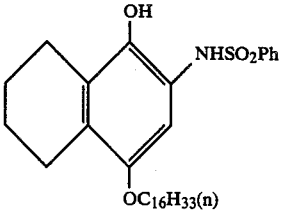
(23)
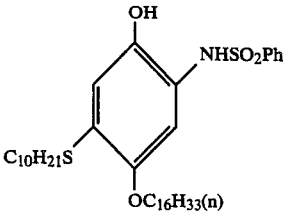
(24)
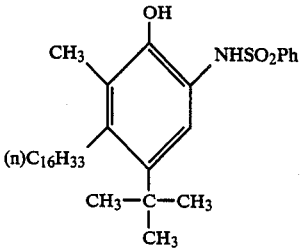

-continued
(25)
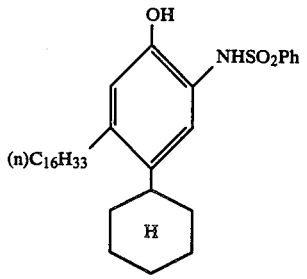
(26)
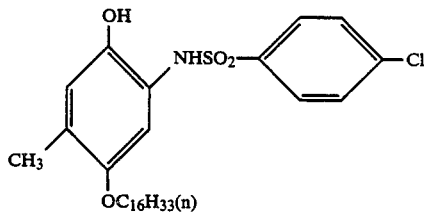
(27)
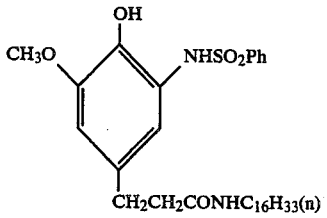
(28)
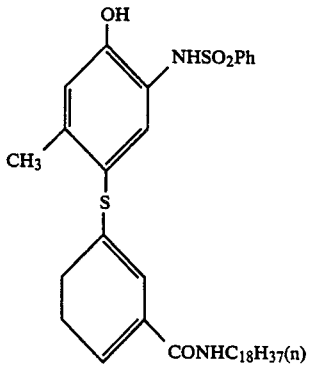
(29)
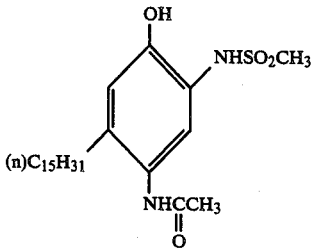
(30)
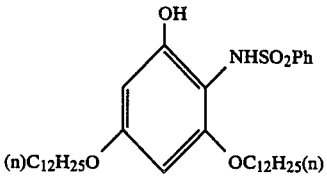
(31)
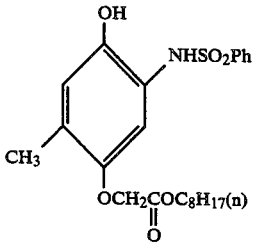
(32)
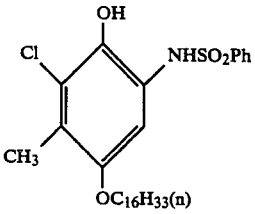
(33)
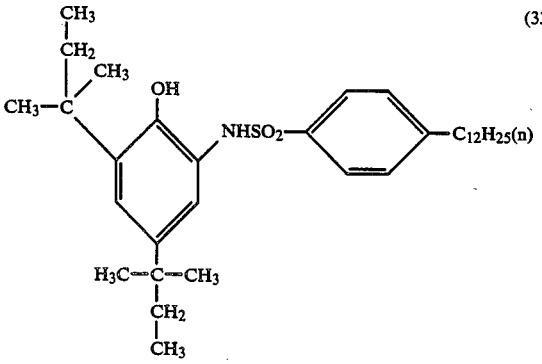

-continued
(34)
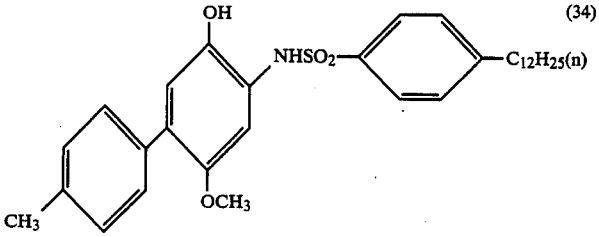
(35)
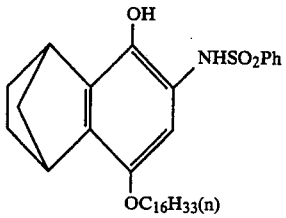
(36)
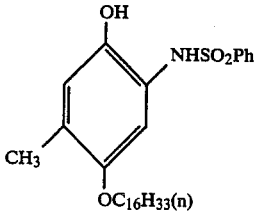
(37)
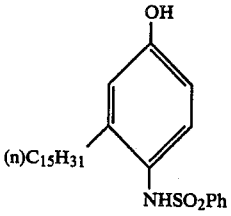
(38)
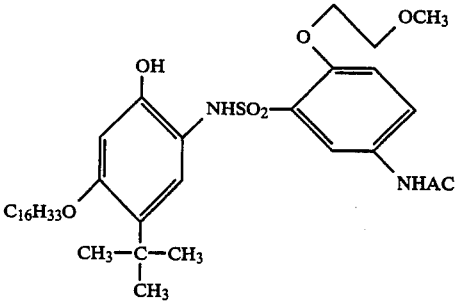
(39)
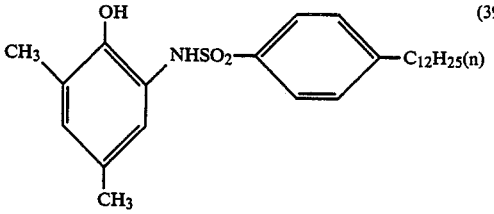
(40)
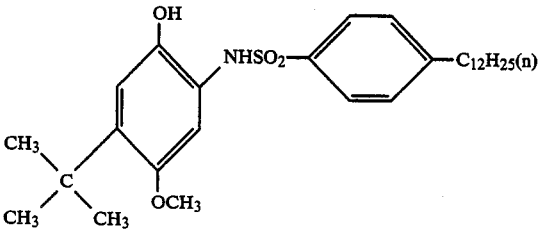
(41)
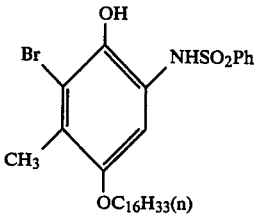
(42)
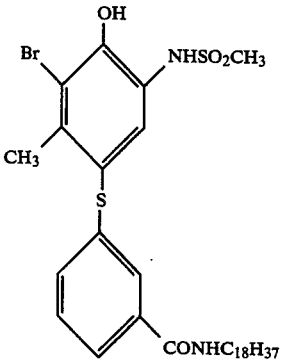
(43)
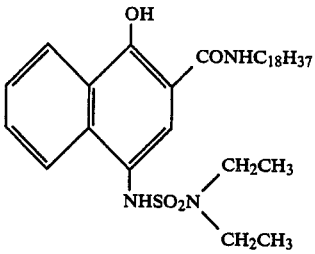
(44)
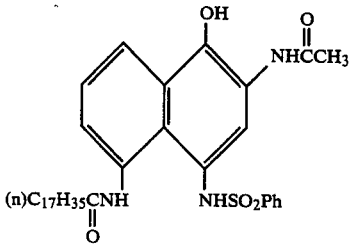
(45)
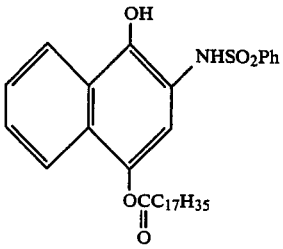

-continued (46)

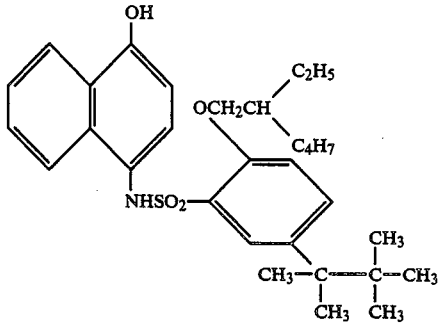

(47)

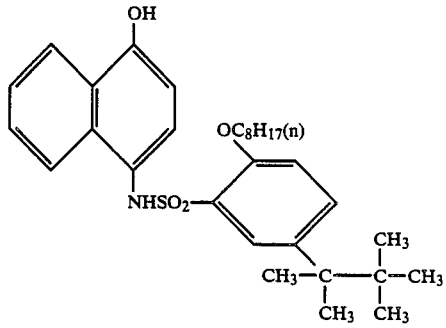

(48)

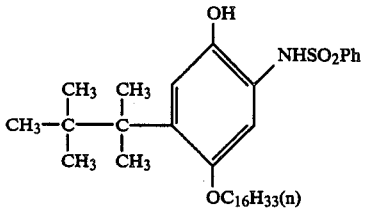

(49)

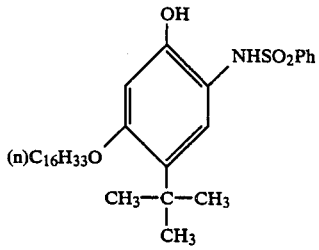

(50)

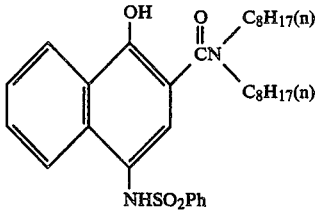

(51)

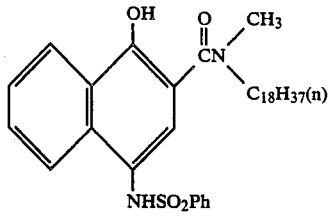

(52)

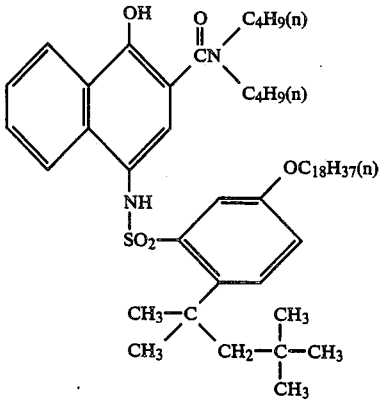

(53)

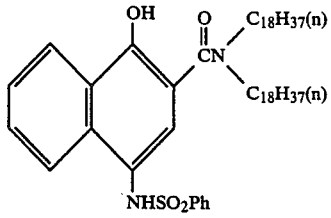

(54)

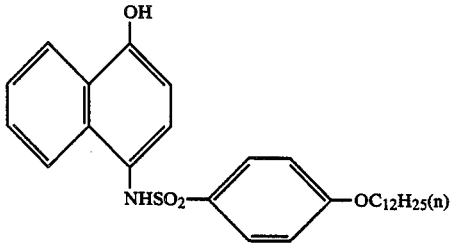

(55)

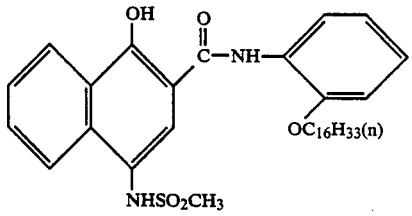

Some of the compounds conforming to general formulas (I) and (II) are described in Research Disclosure, 17842, February 1974, and Japanese Patent Publication No. 56-88136. In the former, they are described as "scavenger compounds" which compete with color imparting compounds with respect to an oxidized product of a developing agent. In the latter, they are described as electron donor (ED) compounds capable of reducing reducible color imparting compounds.

We have discovered that when these compounds are combined with heat-developable photosensitive materials, they are effective in inhibiting air oxidation of a reducing agent, especially a dye-releasing compound of reducing nature normally contained in the photosensitive material to substantially reduce fogging, or promoting heat development to produce a dye image having a high sensitivity or density.

The particularly preferred dye-providing substances used in the heat-developable photosensitive materials of the present invention are dye-releasing compounds of reducing nature and thus do not require another developing agent as they themselves function as a developing agent. The heat-developable photosensitive materials containing the compounds of formula (I) or (II) according to the present invention are thus different from those described in the above-cited Research Disclosure in that the compounds are effective even when they do not function as the "scavengers".

The heat-developable photosensitive materials according to the present invention are also different from those described in the above-cited Japanese Patent Publication in that the dye-releasing compounds of reducing nature are not reduced with the above-mentioned electron donor (ED) compounds.

In general, the addition of a reducing agent to an emulsion layer or a layer adjacent thereto often results in deteriorated shelf stability of photosensitive material, and causes fog like thermal fog particularly in heat development where development takes place at elevated temperatures. Quite unexpectedly, when combined with heat-developable photosensitive materials, the compounds of the invention minimize fog during heat development at elevated temperature and promote the development.

Synthesis of the compounds having general formulas (I) and (II) according to the present invention is described. The present compounds can be synthesized by reaction of a corresponding o- or p-aminophenol or naphthol with an alkyl- or arylsulfonyl chloride according to the following scheme:

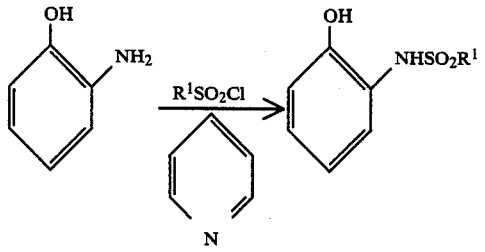

$R^1$: alkyl or aryl radical

Some illustrative synthesis procedures are presented below.

SYNTHESIS 1

Synthesis of Compound (1)

To a mixture of 7.0 grams (16.4 mmol) of 2-(N-hexadecyl)carbamoyl-4-aminonaphthol hydrogen sulfate (i), 7 ml of pyridine, and 40 ml of N,N-dimethylacetamide, was added dropwise 3.0 grams (17.0 mmol) of benzenesulfonyl chloride (ii) while blowing nitrogen gas therein. The mixture was agigated for one hour at room temperature whereupon the reaction solution was poured into cold diluted hydrochloric acid. The separated portion was extracted with 400 ml of ethyl acetate. The ethyl acetate layer was separated, washed with water, dried, and stripped of the solvent under vacuum. The residue was purified by column chromatography with an eluting solution of ½ ethyl acetate/-hexane, obtaining 5.0 grams (8.8 mmol) of compound (1) in white crystal form (yield: 54%).

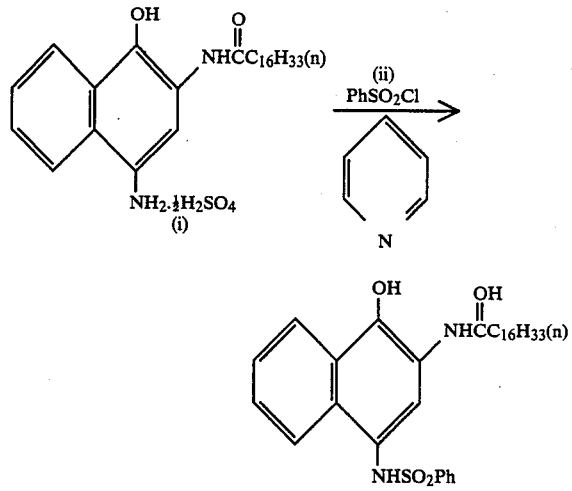

SYNTHESIS 2

Synthesis of compound (37)

The same procedure as for the synthesis of compound (1) was started with 7.0 grams (19.8 mmol) of 3-pentadecyl-4-aminophenol (iii), 7 ml of pyridine, 40 ml of N,N-dimethylacetamide, and 3.5 grams (20.0 mmol) of benzenesulfonyl chloride (ii), obtaining 5.6 grams (10.0 mmol) of compound (37) in a yield of 51%.

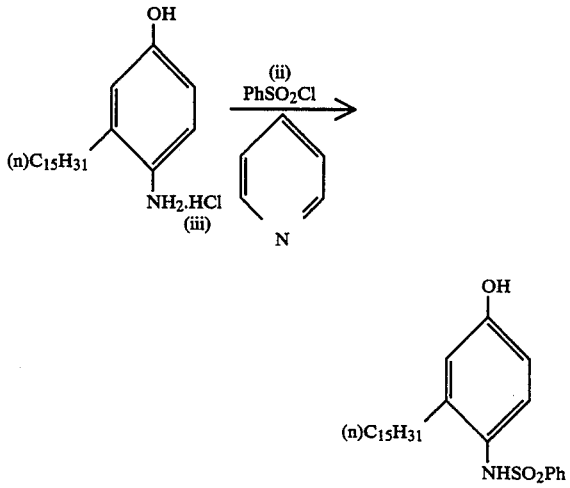

According to a second embodiment of the present invention, the heat-developable photosensitive material comprising on a support at least (1) a photosensitive silver halide, (2) a binder, and optionally, (3) a dye-providing substance further contains (4) a high molecular weight compound comprising monomer units represented by the general formula (III):

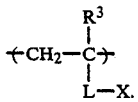

(III)

In formula (III), $R^3$ is selected from the group consisting of hydrogen, halogen, and a lower alkyl radical. The lower alkyl radicals preferably contain 1 to 6 carbon atoms and include methyl, ethyl, butyl, and hexyl radicals.

L represents a single bond or a divalent linkage. The L value preferably contains 0 to 20 carbon atoms in total. Preferred examples of L include a single bond, phenylene radicals (such as p-phenylene and m-phenylene radicals) and alkylene radicals (such as ethylene and n-propylene radicals). Other preferred examples are given below in chemical formulas.

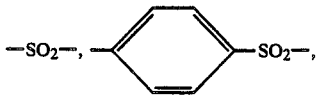

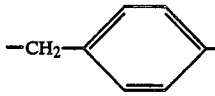

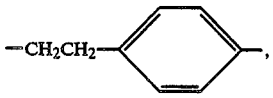

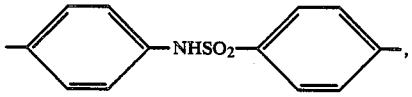

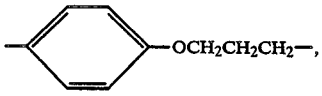

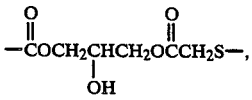

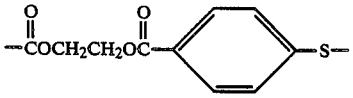

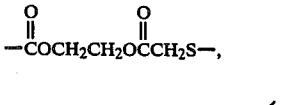

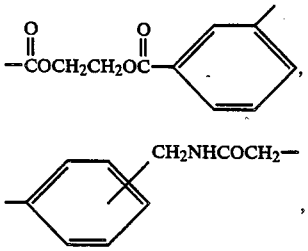

—CONH—,
—COOCH$_2$CH$_2$OCO—,

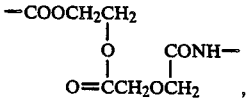

-continued

—COO—,

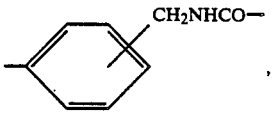

—CONHCH$_2$CH$_2$CONH—,

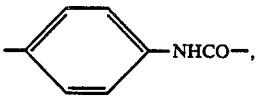

—CONHCH$_2$—,
—CONHCH$_2$CH$_2$—,
—CONHCH$_2$OCOCH$_2$—,
—CONHCH$_2$CH$_2$CH$_2$OCOCH$_2$—
—COOCH$_2$—,
—CONHCH$_2$CONH—,

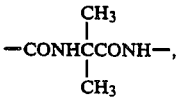

—CONHCH$_2$CH$_2$CH$_2$CONH—,
—CONH(CH$_2$)$_5$CONH—,
—COOCH$_2$CH$_2$—,
—COOCH$_2$CH$_2$OCOCH$_2$—,
—COOCH$_2$CH$_2$CH$_2$OCOCH$_2$—

In formula (III), X is the residue of a compound having the general formula (IV) or (V):

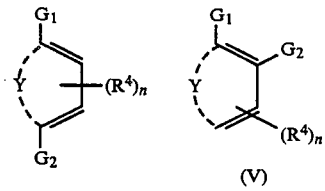

(IV) (V)

In formulas (IV) and (V),

Y represents a group of carbon atoms necessary to complete a benzene or naphthalene nucleus;

G1 and G2 may be the same or different and are independently selected from a hydroxyl radical and a sulfonylamino radical having the general formula (VI):

$$-NHSO_2R^5 \qquad (VI)$$

wherein $R^5$ is a monovalent radical selected from the group consisting of a substituted or unsubstituted alkyl, cycloalkyl, aralkyl, aryl, amino, and heterocyclic radical. $R^5$ is a divalent radical selected from the same group as above when it is further attached to L.

Preferred examples of the $R^5$ radicals include substituted or unsubstituted alkyl radicals having 1 to 32 carbon atoms such as methyl, ethyl, and n-decyl radicals; substituted or unsubstituted cycloalkyl radicals having 5 to 20 carbon atoms such as cyclopentyl and cyclohexyl radicals; substituted or unsubstituted aryl radicals having 6 to 20 carbon atoms such as phenyl and naphthyl radicals; substituted or unsubstituted heterocyclic radicals having 1 to 20 carbon atoms such as pyridyl, furyl, and thienyl radicals; and substituted or unsubstituted amino radicals having 0 to 20 carbon atoms such as amino, hexylamino, and dimethylamino radicals. They are monovalent when $R^5$ is attached to only the adjoining sulfur atom, but divalent when $R^5$ is further attached to L. In the latter, $R^5$ is a radical of the same species as above from which one hydrogen atom is eliminated to form an additional bond site to L.

$R^4$ is a monovalent radical selected from the group consisting of hydrogen, a halogen atom, a hydroxyl radical, a cyano radical, a substituted or unsubstituted alkyl, cycloalkyl, aralkyl, aryl, heterocyclic, alkoxy, aryloxy, acyl, acyloxy, alkyloxycarbonyl, aryloxycarbonyl, carbamoyl, sulfamoyl, alkylsulfonyl, arylsulfonyl, acylamino, alkylthio, arylthio, and amino radical, and a sulfonylamino radical having general formula (VI). $R^4$ is a divalent radical selected from the same radicals except the former four radicals or a single bond when $R^4$ is further attached to L.

Preferred examples of the $R^4$ radicals include a hydrogen atom; a halogen atom; a cyano radical; substituted or unsubstituted alkyl radicals having 1 to 32 carbon atoms such as methyl, ethyl, and t-butyl radicals; substituted or unsubstituted alkenyl radicals having 1 to 20 carbon atoms such as allyl radical; substituted or unsubstituted cycloalkyl radicals having 5 to 20 carbon atoms such as cyclopentyl and cyclohexyl radicals; substituted or unsubstituted aralkyl radicals having 7 to 20 carbon atoms such as benzyl and $\beta$-phenetyl radicals; substituted or unsubstituted aryl radicals having 6 to 20 carbon atoms such as phenyl and naphthyl radicals; substituted or unsubstituted heterocyclic radicals having 1 to 20 carbon atoms such as pyridyl, furyl, and thienyl radicals; substituted or unsubstituted alkoxy radicals having 1 to 20 carbon atoms such as methoxy, butoxy, and methoxyethoxy radicals; substituted or unsubstituted aryloxy radicals having 6 to 20 carbon atoms such as phenoxy radical; substituted or unsubstituted acyl radicals having 1 to 20 carbon atoms such as acetyl and palmitoyl radicals; substituted or unsubstituted acyloxy radicals having 1 to 20 carbon atoms such as acetoxy radical; substituted or unsubstituted alkyloxycarbonyl radicals having 2 to 20 carbon atoms such as methoxycarbonyl radical; substituted or unsubstituted aryloxycarbonyl radicals having 7 to 20 carbon atoms such as phenoxycarbonyl radical; substituted or unsubstituted carbamoyl radicals having 1 to 20 carbon atoms such as methylcarbamoyl and diethylcarbamoyl radicals; substituted or unsubstituted sulfamoyl radicals having 1 to 20 carbon atoms such as dimethylsulfamoyl radical; substituted or unsubstituted alkylsulfonyl radicals having 1 to 20. carbon atoms such as methylsulfonyl radical; substituted or unsubstituted arylsulfonyl radicals having 6 to 20 carbon atoms such as phenylsulfonyl and p-methylphenylsulfonyl radicals; substituted or unsubstituted acylamino radicals having 2 to 20 carbon atoms such as acetylamino and lauroylamino radicals; substituted or unsubstituted alkylthio radicals having 1 to 20 carbon atoms such as methylthio and n-octylthio radicals; substituted or unsubstituted arylthio radicals having 6 to 30 carbon atoms such as phenylthio radical; substituted or unsubstituted amino radicals having 0 to 20 carbon atoms such as amino, hexylamino, and dimethylamino radicals; and sulfonylamino radicals having general formula (VI). They are monovalent when $R^4$ is attached to only the adjoining carbon atom, but divalent when $R^4$ is further attached to L. In the latter, $R^4$ is a radical of the same species as above from which one hydrogen atom is eliminated to form an additional bond site to L.

In formulas (IV) and (V), letter n is an integer having a value of 0 to 5. When n is 2 to 5, a corresponding plurality of $R^4$ may be the same or different and may be combined together to form a ring such as a cyclopentene and cyclohexene ring.

When Y represents a group of carbon atoms necessary to complete a naphthalene nucleus, $R^4$ may be attached to either of the thus formed rings.

L is attached to the X residue at either $R^4$ or $R^5$.

Some illustrative, but non-limiting examples of the monomer units having general formula (III) are given below.

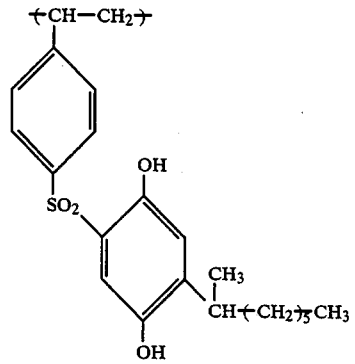

(1)

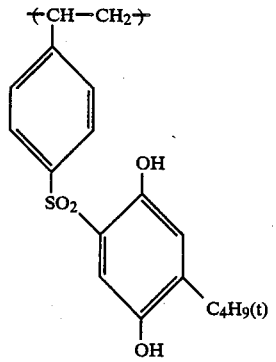

(2)

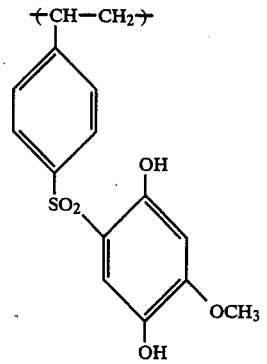

(3)

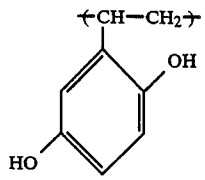

(4)

-continued
(5)
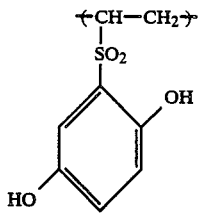
(6)
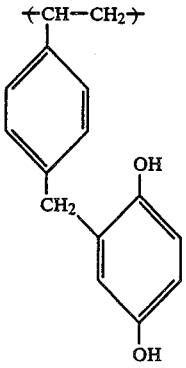
(7)
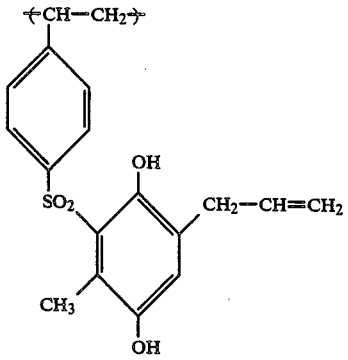
(8)
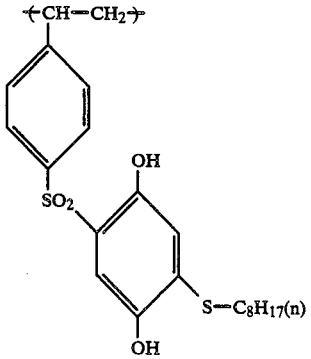
-continued
(9)
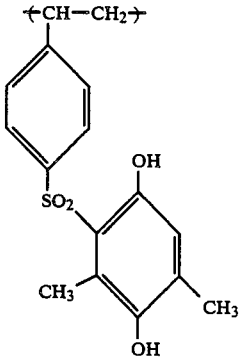
(10)
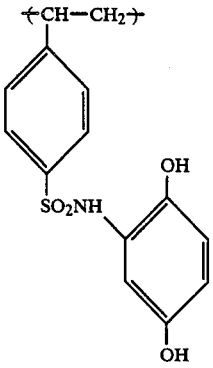
(11)
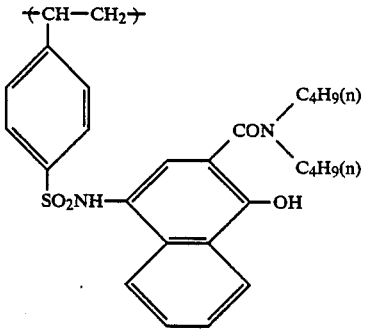
(12)
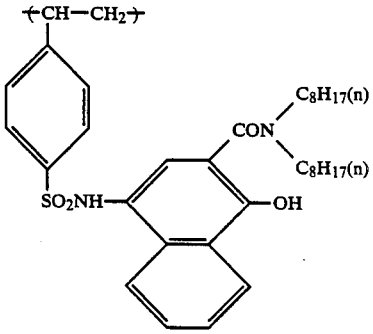

-continued
(13)
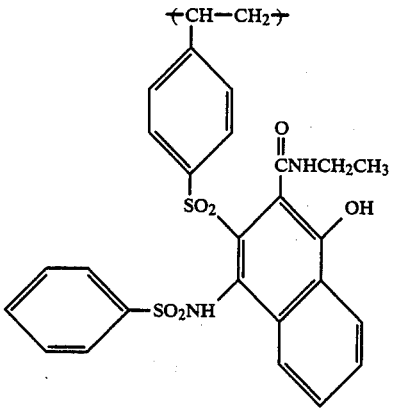
(14)
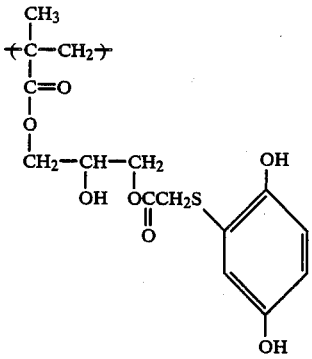
(15)
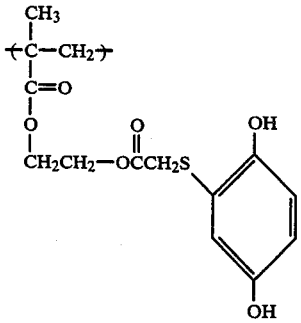
(16)
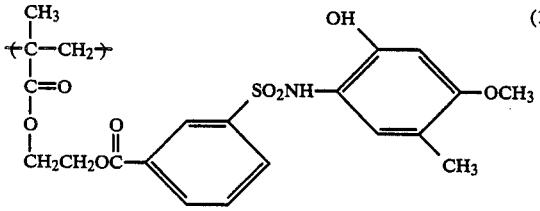
(17)
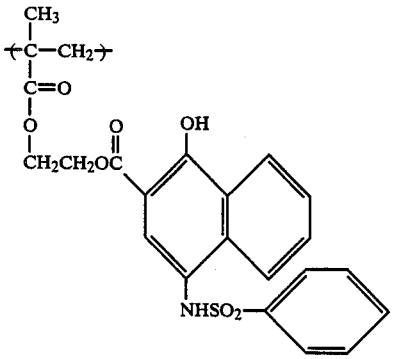
-continued
(18)
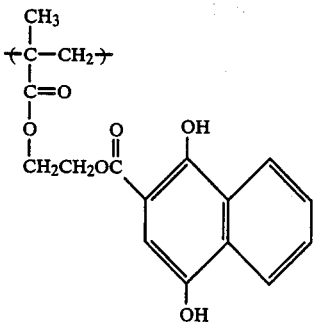
(19)
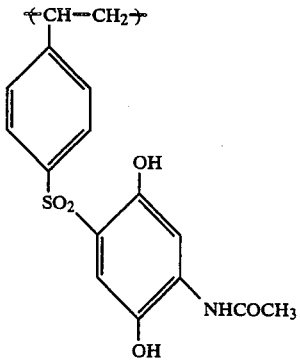
(20)
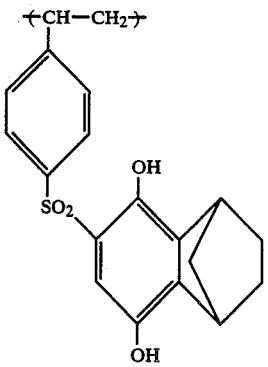
(21)
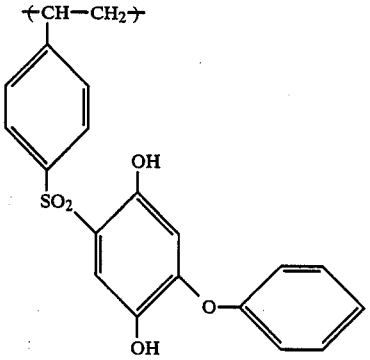

-continued (22)

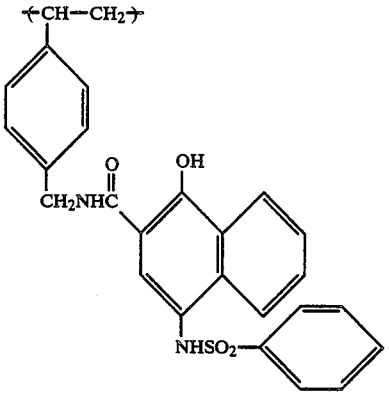

(23)

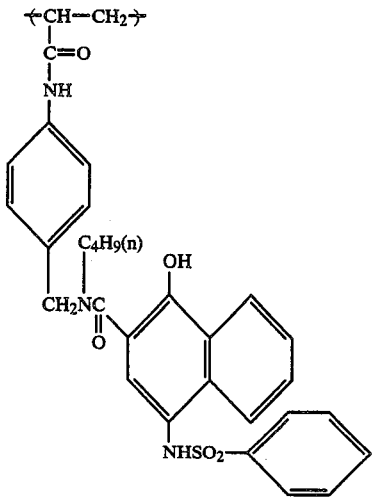

(24)

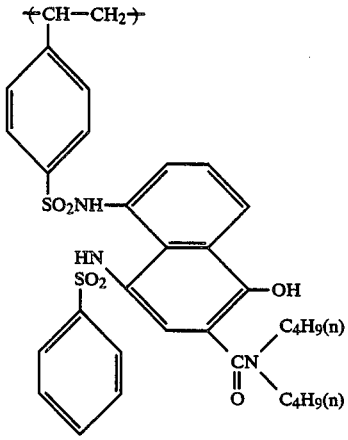

In addition to the monomer units of formula (III), the high molecular weight compounds or polymers according to the present invention may further comprise monomer units of another type. Viny monomers are preferred as the other type of monomer unit. Exemplary of the preferred vinyl monomers there may be given ethylene, propylene, 1-butene, isobutene, styrene, α-methylstyrene, vinyltoluene, monoethylenically unsaturated esters of aliphatic acids (such as vinyl acetate. and allyl acetate), monoethylenically unsaturated amides of aliphatic acids (such as N-vinyl acetamide and N-vinyl pyrolidone), esters of ethylenically unsaturated mono- and dicarboxylic acids (such as methyl methacryalte, ethyl acrylate, n-butyl acrylate, benzyl acrylate, diethyl maleate, and diethyl itaconate), ethylenically unsaturated monocarboxylic acid amides (such as acrylamide, dimethylacrylamide, methacrylamide, diacetonacrylamide, acryloylmorpholine, and sodium 2-methyl-2-acrylamidepropane sulfonate), monoethylenically unsaturated compounds (such as acrylonitrile), and dienes (such as butadiene and isoprene), with the styrene, esters of ethylenically unsaturated carboxylic acids, and ethylenically unsaturated carboxylic acid amides being most preferred.

When it is desired that the compounds according to the present invention are of three-dimensional network structure, vinyl monomers having at least two unsaturated bonds in their molecule may be used.

The compounds according to the present invention may be crosslinked with any well-known crosslinking agents.

In the practice of the present invention, the monomer units of formula (III) comprise at least 1 mol %, preferably at least 5 mol %, and most preferably at least 30 mol % of the compound. The average molecular weight of the compound according to the present invention preferably ranges from 1,000 to 4,000,000, more preferably from 10,000 to 1,000,000 from standpoints of photographic character and applicability.

Illustrative examples of the preferred compounds used in the practice of the present invention are presented below.

(1) Polymers obtained by attaching a compound represented by general formula (IV) or (V) to a branch from a polymer backbone are illustrated by a monomer unit of formula (III) (identified by number) as comprising a monomer unit in the polymer (molar percent ratio in the case of copolymer with another monomer) and a compound of general formula (IV) or (V) along with a percentage substitution.

(P-1 11)

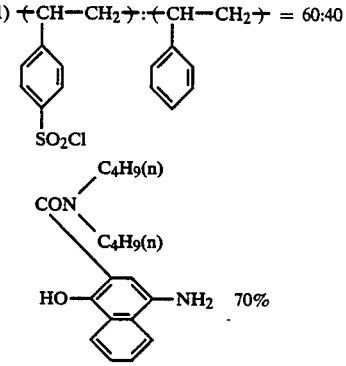

(P-2 15)

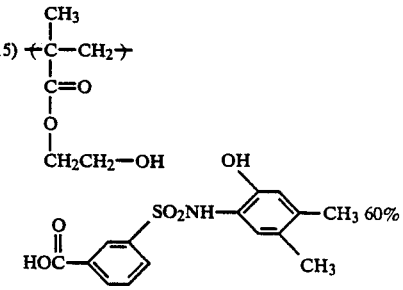

-continued (P-3 17) 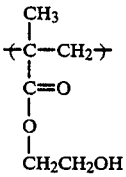

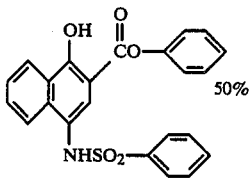

50%

(P-4 23) 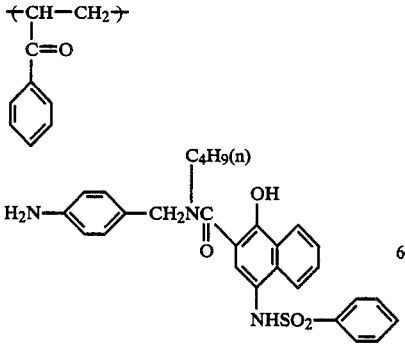

60%

(P-5 24) 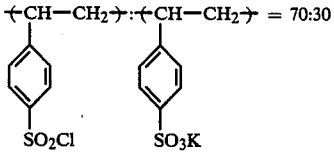

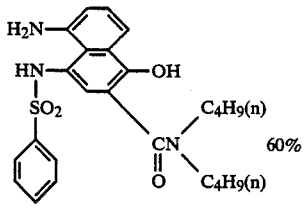

60%

(2) Copolymers are illustrated as comprising a monomer unit of formula (III) (identified by number) and another monomer copolymerized therewith in molar percent ratio.

(P-6 2): 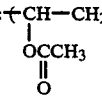 = 30:70

(P-7 3): 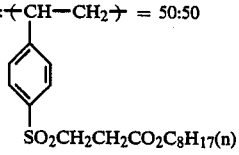 = 50:50

(P-8 1): 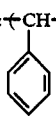 = 80:20

-continued (P-9 8): 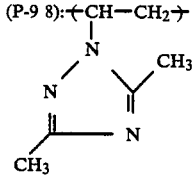 = 80:20

(P-10 9): 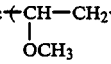 = 90:10

(P-11 19): 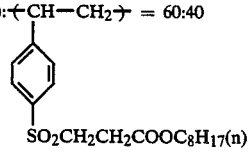 = 60:40

(P-12 1): 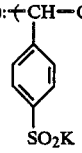 = 95:5

(P-13 20): 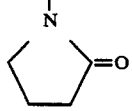 = 70:30

(P-14 21): 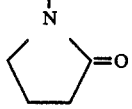 = 50:50

The high molecular weight compounds or polymers according to the present invention may be synthesized by any of the methods known from Kiichi Takemoto, "Functional Polymers", Asakura Shoten, Tokyo (1974); Amane Kanbara, "Functional Polymers (Polymer Experimental Research 7)", Kyoritsu Shuppan, Tokyo (1974); and Japanese Patent Application Kokai No. 57-17949.

The compounds according to the first and second embodiment of the present invention may be used alone or in admixture of two or more. They may be incorporated in any layers of photosensitive material including an emulsion layer, intermediate layer, and protective layer. Most advantageously, they are added to the same layer as the dyeproviding substance or an emulsion layer when their primary purpose is to promote development. They are advantageously added to an intermediate layer when their primary purpose is to prevent color mixing. They are added to any of the above-mentioned layers, more advantageously to an uppermost layer or a layer adjacent thereto when their primary purpose is to prevent air oxidation of any compounds in photosensitive material. Of course, they may be concurrently added to more than one layer for the combined purposes.

The amount of the compound added is 0.0005 to 20 mols, preferably 0.001 to 4 mols per mol of silver.

The silver halides used in the present invention include silver chloride, silver bromide, silver iodide, silver chlorobromide, silver chloroiodide, silver iodobromide, and silver chloroiodobromide, but not limited thereto.

Useful are silver halide emulsions as disclosed in, inter alia, U.S. Pat. No. 4,500,626, col. 50; Research Disclosure, June 1978, pages 9–10 (RD 17029); and Japanese Patent Application Nos. 59-228551, pages 35≧36, which are all incorporated herein by reference.

The silver halide emulsions may be applied without post-ripening, but ordinarily after chemical sensitization. For chemical sensitization purpose, there may be used sulfur sensitization, reducing sensitization, noble metal sensitization and other processes which are well known in connection with the emulsions for photosensitive materials of the ordinary type, and combinations thereof. Such chemical sensitization may be carried out in the presence of a nitrogen-containing heterocyclic compound as disclosed in Japanese Patent Application Kokai Nos. 58-126526 and 58-215644.

The silver halide emulsions used in the practice of the present invention may be either of the surface latent image type wherein latent images are predominantly formed on the grain surface or of the internal latent image type wherein latent images are formed in the grain interior. Core-shell emulsions are also useful wherein the interior and surface layer of grains are of different phases. Also employable is a direct reversal emulsion having an internal latent image type emulsion combined with a nucleating agent.

The amount of the photosensitive silver halide coated preferably ranges from 1 mg to 10 g of silver per square meter.

In the practice of the present invention, an organic metal salt may be used as an oxidizing agent in combination with the photosensitive silver halide. It is necessary that the photosensitive silver halide and the organic metal salt be in contact with or close to each other. Preferred organic metal salts are organic silver salts.

The organic compounds which can be used in the preparation of the organic silver salt oxidizing agents include those compounds disclosed in Japanese Patent Application No. 59-228551, pages 37≧39 and U.S. Pat. No. 4,500,626. Also useful are silver salts of carboxylic acids having an alkynyl radical such as silver phenylpropiolate as disclosed in Japanese Patent Application No. 58-221535.

These organic silver salts may be used in amounts of from 0.01 to 10 mols, preferably from 0.01 to 1 mol per mol of the photosensitive silver halide. The combined amount of the photosensitive silver halide and the organic silver salt coated suitably ranges from about 50 $mg/m^2$ to 10 $g/m^2$ calculated as silver.

The silver halides used in the practice of the present invention may be spectrally sensitized with methine dyes and other dyes. The dyes useful for spectral sensitization include cyanine dyes, merocyanine dyes, complex cyanine dyes, complex merocyanine dyes, holopolar cyanine dyes, hemicyanine dyes, styryl dyes, and hemioxonol dyes. Illustrative examples are the sensitizing dyes disclosed in Japanese Patent Application Kokai Nos. 59-180550 and 60-140335 and Research Disclosure, June 1978, pages 12–13 (RD 17029); and the sensitizing dyes of heat-decoloring nature disclosed in Japanese Patent Application Kokai No. 60-111239 and Japanese Patent Application No. 60-172967. These sensitizing dyes may be used individually or as a combination thereof. A combination of sensitizing dyes is frequently used for supersensitization.

In addition to the sensitizing dye, the emulsion may contain a dye which itself has no spectral sensitization function or a material which does not substantially absorb visible light, but is capable of supersensitization. Such supersensitizing compounds are disclosed in the following U.S. Pat. Nos.:

| | | |
|---|---|---|
| 2,933,390 | 3,635,721 | 3,635,721 |
| 3,743,510 | 3,615,613 | 3,615,641 |
| 3,617,295 | 3,635,721. | |

These sensitizing dyes may be added to the emulsion during, before or after chemical ripening, or before or after nucleation of silver halide grains according to the teachings of U.S. Pat. Nos. 4,183,756 and 4,225,666. The amount of the sensitizing dye is generally from $10^{-8}$ to $10^{-2}$ mol per mol of the silver halide.

In the practice of the present invention, silver may be used as an image-forming material. Also, there may be contained a compound which, when the photosensitive silver halide or silver ion is reduced into silver at elevated temperatures, produces or releases a mobile or diffusible dye in direct or inverse proportion to the reaction. These compounds are simply referred to as dye-providing substances hereinafter.

Typical of the dye-providing substances which can be used in the present invention are couplers capable of reaction with developing agents. In the system using a coupler, a silver salt and a developing agent make a redox reaction to form an oxidant of the developing agent which in turn, reacts with the coupler to form a dye. Illustrative examples of the developing agents and couplers are described in detail in, for example, T. H. James, "The Theory of the Photographic Process", 4th Ed., pages 291≧334 and 354–361, and the following laid-open specifications.

Japanese Patent Application Kokai Nos:

| | | |
|---|---|---|
| 58-123533 | 58-149046 | 58-149047 |
| 59-111148 | 59-124399 | 59-174835 |
| 59-231539 | 59-231540 | 60-2950 |
| 60-2951 | 60-14242 | 60-23474 |
| 60-66249. | | |

The dye-providing substances employable other than the aforementioned include dye-silver compounds in which an organic silver salt is combined with a dye. Examples of the dye-silver compounds are described in Research Disclosure, May 1978, pages 54–58(RD-16966). Also included are azo dyes useful in heat development silver dye bleaching process. Examples of the azo dyes and bleaching process are described. in U.S. Pat. No. 4,235,957 and Research Disclosure, April 1976, pages 30–32 (RD-14433). A further example of the dye-providing substance is leuco dyes as described in U.S. Pat. Nos. 3,985,565 and 4,022,617.

Another class of dye-providing substances includes compounds having the function of releasing or diffusing a diffusible dye imagewise. The compounds of this type may be represented by the following formula [L I]:

$$(\text{Dye-X})_n - Y \qquad [\text{L I}]$$

wherein Dye represents a dye group, a temporarily wavelength shortened dye group or a dye precursor group; X represents a single bond or a connecting linkage; and Y represents a group which, in correspondence or counter-correspondence to photosensitive silver salt having a latent image distributed imagewise, produces a difference in diffusibility of the compound represented by $(Dye\text{-}X)_n\text{-}Y$ or releases Dye, the diffusibility of Dye released being different from that of the compound represented by $(Dye\text{-}X)_n\text{-}Y$; and n represents an integer of 1 or 2, when n=2, the Dye-X's may be the same or different. More specifically, X is $—SO_2—$ or a group which can be split off from Y by the coupling reaction of Y with an oxidant of a developing agent. The splittable groups represented by Y are described in U.S. Pat. Nos. 4,483,914 and 4,474,867.

Exemplary of the dye-providing substances having general formula [L I] there may be given dye developing reagents in the form of a hydroquinone-type developing reagent having a dye moiety attached thereto as disclosed in U.S. Pat. Nos. 3,134,764; 3,362,819; 3,597,200; 3,544,545; and 3,482,972. In addition, substances which release a diffusible dye through intramolecular nucleophilic substitution reaction are disclosed in U.S. Pat. No. 3,980,479, and substances which releases a diffusible dye through intramolecular rewind reaction of an isooxazolone ring are disclosed in Japanese Patent Application Kokai No. 49-111628. In the systems to which these substances are applied, a diffusible dye is released or diffused where no development has taken place and no dye is released or diffused where development has taken place.

Another system is proposed wherein the dye-providing substance is previously modified into an oxidant form having no dye releasing ability so that the modified substance may coexist with a reducing agent or precursor thereof. After development, the reducing agent which remains non-oxidized acts on the modified substance to reduce it, thereby releasing the diffusible dye. Typical examples of the dye-providing substances usable in such a system are described in Japanese Patent Application Kokai Nos. 53-110827, 54-130927, 56-164342, and 53-35533.

Also known are substances which release a diffusible dye where development has occurred. Couplers having a diffusible dye as an eliminatable group and thus releasing a diffusible dye through reaction with an oxidant of a developing reagent, known as DDR couplers, are described in British Pat. No. 1,330,524; Japanese Patent Publication No. 48-39165; U.S. Pat. No. 3,443,940 and the like.

The systems using these reducing agents have the serious problem that the resulting image can be contaminated with oxidation decomposition products of a reducing agent. To overcome this problem, dye-releasing (DRR) compounds have been proposed which themselves have reducing nature without the need for a reducing agent. Advantageous results are obtained particularly when such reducing dye-releasing compounds are combined with the heat-developable photosensitive materials of the present invention. Typical examples of these compounds are dye-providing substances described in the following publications:

| | | |
|---|---|---|
| U.S. Pat. Nos. | 3,725,062, | 3,728,113, |
| 3,443,939, | 3,928,312, | 4,053,312, |
| 4,055,428, | 4,336,322, | 4,500,626. |
| Japanese Patent Application Kokai Nos. | | |
| 59-65839, | 59-69839, | 58-116537, |
| 57-179840, | 53-3819, | 51-104343 |

-continued

| |
|---|
| Research Disclosure, RD 17465. |

Most typical examples of the dye-providing substances are given below. The definition of letters used in the following general formulas is found in the corresponding publications.

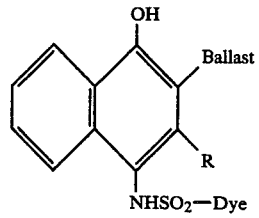

U.S. Pat. No. 3,928,312, etc.

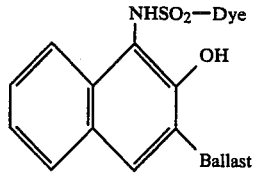

U.S. Pat. No. 4,053,312, etc.

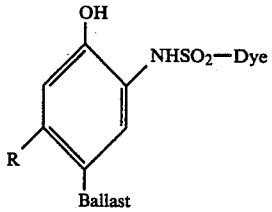

U.S. Pat. No. 4,055,428, etc.

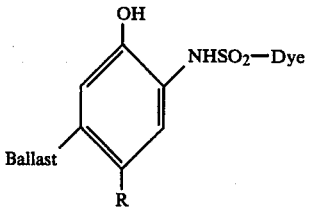

U.S. Pat. No. 4,336,322

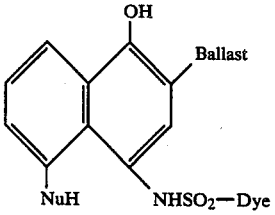

JP Pat. Appln. Kokai No. 59-65,839

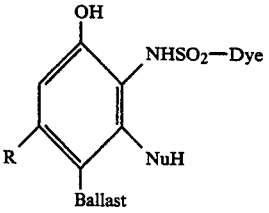

JP Pat. Appln. Kokai No. 59-69,839

-continued

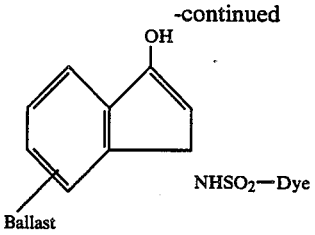

JP Pat. Appln. Kokai No. 53-3,819

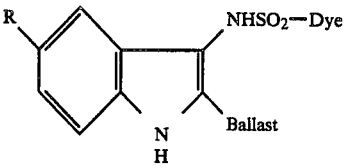

JP Pat. Appln. Kokai No. 51-104,343

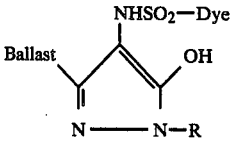

JP Pat. Appln. Kokai No. 51-104,343

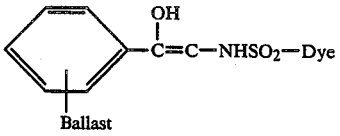

JP Pat. Appln. No. 51-104,343

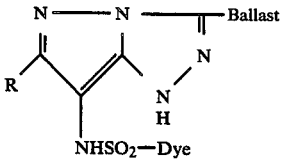

Research Disclosure, No. 17,465

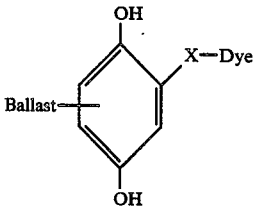

U.S. Pat. No. 3,725,062

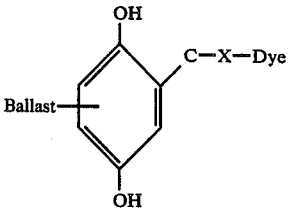

U.S. Pat. No. 3,728,113

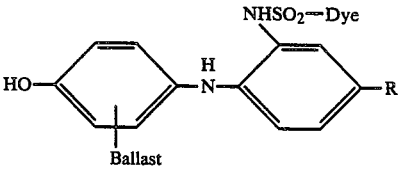

U.S. Pat. No. 3,443,939

-continued

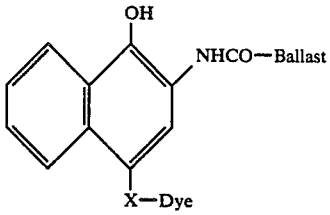

JP Pat. Appln. Kokai No. 58-116,537

Representative examples of these dye-providing substances are those compounds described in the above-incorporated U.S. Pat. No. 4,500,626, columns 22–44, most preferably the compounds identified therein as compounds (1)–(3), (10)–(13), (16)–(19), (28)–(30), (33)–(35), (38)–(40), and (42)–(64). Also useful are the compounds described in Japanese Patent Application Kokai No. 61-124941.

Particularly preferred among the dye-providing substances used in the practice of the present invention are reducing dye-providing substances capable of releasing a hydrophilic diffusible dye and having the general formula:

$$Ra—SO_2—D \qquad (A)$$

wherein

Ra represeants a reducing substrate capable of being oxidized with the silver halide, and D is an image forming dye moiety having a hydrophilic group.

The reducing substrates Ra of the dye-providing substances $Ra—SO_2—D$ are preferred to have an oxidation-reduction potential of up to 1.2 volts with respect to a saturated calomel electrode in a polarographic half-wave potential measurement using acetonitrile as a solvent and sodium perchlorate as a supporting electrolyte. Some illustrative examples of the preferred substrates Ra are given below under general formulas (A-1) through (A-8).

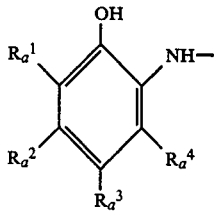

(A-1)

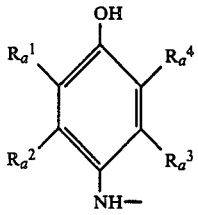

(A-2)

-continued (A-3)

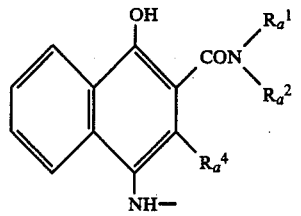

(A-4)

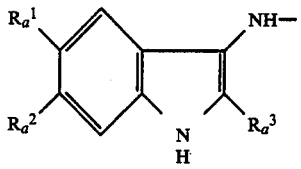

(A-5)

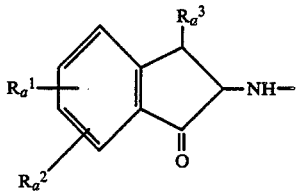

(A-6)

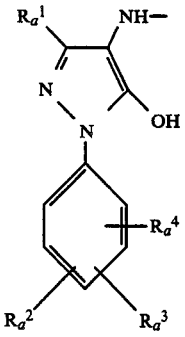

(A-7)

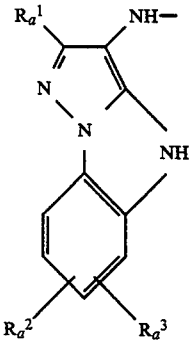

(A-8)

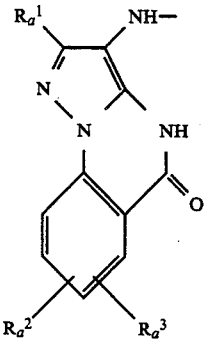

In these formulas, $Ra^1$, $Ra^2$, $Ra^3$, and $Ra^4$ are independently selected from hydrogen, halogen atoms, and alkyl, cycloalkyl, aryl, alkoxy, aryloxy, aralkyl, acyl, acylamino, alkylsulfonylamino, arylsulfonylamino, aryloxyalkyl, alkoxyalkyl, N-substituted carbamoyl, N-substituted sulfamoyl, alkylthio, and arylthio radicals. In these radicals, the alkyl and aryl values may be substituted with an alkoxy radical, halogen atom, hydroxyl radical, cyano radical, acyl radical, acylamino radical, substituted carbamoyl radical, substituted sulfamoyl radical, alkylsulfonylamino radical, arylsulfonylamino radical, substituted ureido radical or carboalkoxy radical. The hydroxyl and amino values contained in Ra may be protected with a protecting group which can be regenerated under the action of a nucleophilic reagent.

In a more preferred embodiment of the present invention, the reducing substrate Ra is represented by the formula (X):

(X)

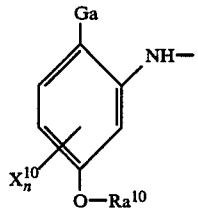

wherein G is a hydroxyl radical or a radical hydrolyzable into a hydroxyl radical, $Ra^{10}$ is an alkyl or aromatic radical, and n is an integer having a value of 1 to 3.

When n is equal to 1, $X^{10}$ is an electron donative substituent. When n is equal to 2 or 3, $X^{10}$'s may be the same or different. When one of $X^{10}$'s is an electron donative substituent and the second and third ones are electron donative substituents or halogen atoms. $X^{10}$ itself may form a fused ring or it may form a ring with $ORa^{10}$. The total number of carbon atoms contained in $Ra^{10}$ and $X^{10}$ is 8 or more.

Most preferred among the reducing substrates Ra included in formula (X) are those represented by the following formulas (Xa) and (Xb).

(Xa)

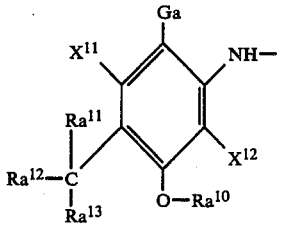

In formula (Xa), Ga is a hydroxyl radical or a radical hydrolyzable into a hydroxyl radical. $Ra^{11}$ and $Ra^{12}$ may be the same or different and are alkyl radicals or, taken together, form a ring. $Ra^{13}$ is hydrogen or an alkyl radical, and $Ra^{10}$ is an alkyl or aromatic radical. $X^{11}$ and $X^{12}$ may be the same or different and are independently selected from hydrogen, alkyl, alkoxy, halogen, acylamino, and alkylthio radicals. $Ra^{10}$ and $X^{12}$, or $Ra^{10}$ and $Ra^{13}$ may be combined together to form a ring.

(Xb)

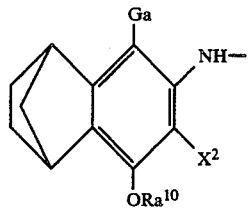

In formula (Xb), Ga is a hydroxyl radical or a radical hydrolyzable into a hydroxyl radical, $Ra^{10}$ is an alkyl or aromatic radical, and $X^2$ is selected from hydrogen, alkyl, alkoxy, halogen, acylamino, and alkylthio radicals. $Ra^{10}$ and $X^2$ may be combined together to form a ring.

Examples of the reducing substrates included in formulas (X), (Xa), and (Xb) are illustrated in U.S. Pat. No. 4,055,428, and Japanese Patent Application Kokai Nos. 56-12642 and 56-16130.

In another preferred embodiment of the present invention, the reducing substrate Ra is represented by the general formula (XI):

(XI)

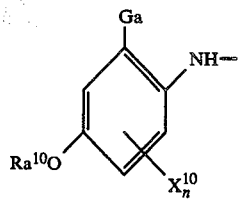

wherein Ga, $X^{10}$, $Ra^{10}$, and n are as defined in formula (X).

Most preferred among the reducing substrates Ra represented by general formula (XI) are those represented by the following formulas (XIa), (XIb), and (XIc).

(XIa)

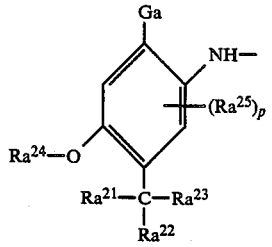

In formula (XIa),

Ga is a hydroxyl radical or a radical hydrolyzable into a hydroxyl radical, $Ra^{21}$ and $Ra^{22}$ may be the same or different and independently selected from alkyl and aromatic radicals, $Ra^{21}$ and $Ra^{22}$ may be combined together to form a ring, $Ra^{23}$ is a hydrogen atom, alkyl radical or aromatic radical, $Ra^{24}$ is an alkyl or aromatic radical, $Ra^{25}$ is selected from alkyl, alkoxy, alkylthio, arylthio, halogen, and acylamino radicals, p is equal to 0 1 or 2, $R^{24}$ and $R^{25}$ may be combined to form a fused ring, $Ra^{21}$ and $Ra^{25}$ may be combined to form a fused ring, or $Ra^{21}$ and $Ra^{25}$ may be combined to form a fused ring, and the total number of carbon atoms contained in $Ra^{21}$, $Ra^{22}$, $Ra^{23}$, $Ra^{24}$, and $(Ra^{25})_p$ is 7 or more.

(XIb)

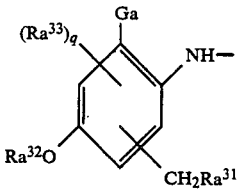

In formula (XIb),

Ga is a hydroxyl radical or a radical hydrolyzable into a hydroxyl radical, $Ra^{31}$ is an alkyl or aromatic radical, $Ra^{32}$ is an alkyl or aromatic radical, $Ra^{33}$ is an alkyl, alkoxy, alkylthio, arylthio, halogen, or acylamino radical, q is equal to 0, 1 or 2, $Ra^{32}$ and $Ra^{33}$ may be combined to form a fused ring, $Ra^{31}$ and $Ra^{32}$ may be combined to form a fused ring, or $Ra^{31}$ and $Ra^{33}$ may be combined to form a fused ring, and the total number of carbon atoms contained in $Ra^{31}$, $Ra^{32}$, and $(Ra^{33})_q$ is 7 or more.

(XIc)

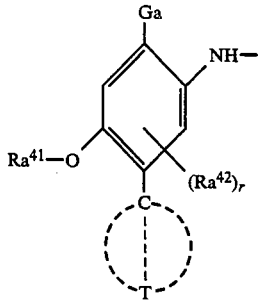

In formula (XIc),

Ga is a hydroxyl radical or a radical hydrolyzable into a hydroxyl radical, $Ra^{41}$ is an alkyl or aromatic radical, $Ra^{42}$ is an alkyl, alkoxy, alkylthio, arylthio, halogen, or acylamino radicals, r is equal to 0, 1 or 2,

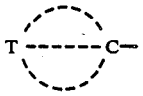

radical is a radical having two to four saturated hydrocarbon rings fused and the carbon atom

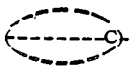

in the fused ring participating in its attachement to the phenol (or precursor thereof) mother nucleus is a tertiary carbon atom constituting one of the key members of the fused ring. Some of the carbon atoms in the hydrocarbon ring except said tertiary carbon atom may be replaced by oxygen atoms or the hydrocarbon ring may have a substituent attached thereto or an aromatic ring fused thereto. $Ra^{41}$ or $Ra^{42}$ may form a fused ring with the above-defined

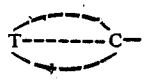

radical. The total number of carbon atoms contained in $Ra^{41}$, $(Ra^{42})_r$, and

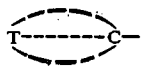

is at least 7.

Preferred examples of the reducing substrates included in formulas (XI), and (XIa) to (XIc) are described in Japanese Patent Application Nos. 56-16131, 57-650, and 574043.

An essential portion in formulas (A-2) and (A-3) is the para-(sulfonyl)aminophenol portion.

Illustrative examples are the reducing substrates disclosed in U.S. Pat. Nos. 3,928,312, 4,076,529, 4,135,929, and 4,258,120 and U.S. published application No. B 351,673. They are all useful as reducing substrate Ra in the practice of the present invention.

In a further preferred embodiment of the present invention, the reducing substrate Ra is represented by the formula:

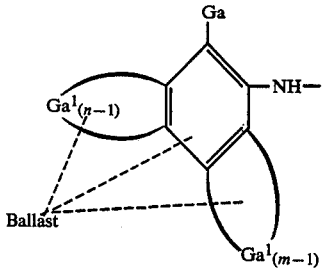

(XII)

wherein Ballast represents an anti-diffusing radical, Ga is a hydroxyl radical or a hydroxyl precursor, $Ga^1$ is an aromatic ring which forms a naphthalene ring with the adjoining benzene ring, and n and m are different integers having a value of 1 or 2. Illustrative examples of the compounds of formula (XII) are described in U.S. Pat. No. 4,053,312.

The reducing substrates of formulas (A-4), (A-6), (A-7), and (A-8) are characterized by the presence of a heterocycle. Their illustrative examples are described in U.S. Pat. Nos. 4,198,235 and 4,273,855 and Japanese Patent Application Kokai No. 53-46730. Examples of the reducing substrates of formula (A-5) are described in U.S. Pat. No. 4,149,892.

The reducing substrate Ra is required to have the following properties.

(1) It must be quickly oxidized by the silver halide and efficiently release an image-forming diffusible dye under the action of a dye releasing aid.

(2) It must be highly hydrophobic because it is necessary that the dye-providing substance be undiffusible in a hydrophilic or hydrophobic binder and only the dye released therefrom be diffusible.

(3) It is so stable against heat and a dye releasing aid that it does not release an image-forming dye until it is oxidized.

(4) It is readily synthesized. Preferred examples of the reducing substrates Ra meeting these requirements are described in U.S. Pat. No. 4,500,626.

The dye moieties represented by D in formula (A) are those derived from azo dyes, azomethine dyes, anthraquinone dyes, naphthoquinone dyes, styryl dyes, nitro dyes, quinoline dyes, carbonyl dyes and phthalocyanine dyes, but not limited thereto. These dye moieties can also take the form having temporarily shortened wavelengths and capable of reproducing the original color during development.

In the practice of the present invention, the dye-providing substances and other hydrophobic additives such as image formation accelerators as will be described later may be introduced into a layer of photosensitive material by any well-known methods, for example, the method described in U.S. Pat. No. 2,322,027. In this case, an organic solvent having a high boiling point as described in Japanese Patent Application Kokai Nos. 59-83154, 59-178451, 59-178452, 59-178453, 59-178454, 59-178455, and 59-178457 may be used, optionally in admixture with an organic solvent having a low boiling point in the range of from 50° C. to 160° C. The amount of the high boiling organic solvent used in the present invention is up to 10 grams, preferably up to 5 grams per gram of the dye-providing substance.

Further, it is possible to use a method for dispersion in polymers as described in Japanese Patent Publication No. 51-39853 and Japanese Patent Application Kokai No. 51-59943.

In case the substance is substantially insoluble in water, it may be finely divided into particles before being incorporated in the binder although the aforementioned methods may also be applicable. Moreover, various surface-active agents may be used when a hydrophobic substance like the dye-providing substance is dispersed in a hydrophilic colloid. For this purpose, the surface-active agents illustrated in Japanese Patent Application Kokai No. 59-157636, incorporated herein by reference, pages 37–38 may be used.

A reducing agent may desirably be used in the photosensitive material in the practice of the present invention. The reducing agents used herein include well-known reducing agents and the above-mentioned dye-providing substances having reducing ability. Also included are reducing agent precursors which themselves have no reducing nature, but exhibit reducing nature under the action of a nucleophilic agent or heat during the development process.

Examples of the reducing agents used herein include those reducing agents described in U.S. Pat. No. 4,500,626, columns 49–50, U.S. Pat. No. 4,483,914, columns 30–31, Japanese Patent Application Kokai No. 60-140335, pages 17–18, and Japanese Patent Application Kokai Nos. 60-128438, 60-128436, 60-128439, and 60-128437. Also useful are reducing agent precursors as disclosed in Japanese Patent Application Kokai Nos. 56-138736 and 57-40245, U.S. Pat. No. 4,330,617, and the like. Various combinations of reducing agents as described in U.S. Pat. No. 3,039,869 may also be used.

In the practice of the present invention, the reducing agent may be added in amounts of from 0.01 to 20 mols, preferably from 0.1 to 10 mols per mol of silver.

An image formation promotor may also be used in the photosensitive material in the practice of the present invention. The image formation promotors have the functions of promoting such reaction as redox reaction of a silver salt-oxidizing agent with a reducing agent, formation of a dye from a dye-providing substance, decomposition of a dye or release of a mobile dye, and promoting transfer of a dye from a photosensitive material layer to a dye-fixing layer. From their physical-chemistry, they may be classified into bases, base precursors, nucleophilic compounds, high-boiling organic solvents (oils), thermal solvents, surface-active agents, and compounds capable of interacting with silver or silver ion. It should be noted that these compounds generally have multiple functions and thus possess some of the abovementioned promoting effects combined. For further detail, reference is to be made to Japanese Patent Application No. 59-213978, pages 67-71.

A number of other base-producing methods are known and any of the compounds used in these methods are useful as the base precursor. For example, copending U.S. patent application Ser. No. 890,442, filed July 30, 1986 and assigned to the same assignee as the present invention discloses a method for producing a base by mixing a difficultly soluble metal compound with a compound (complexing compound) capable of forming a complex with the metal ion of the metal compound, and Japanese Patent Application No. 60-74702 discloses electrolytic base generation.

The former method is particularly effective. Examples of the difficultly soluble metal compounds include carbonates, hydroxides, and oxides of zinc, aluminum, calcium, and barium. The complexing compounds are detailed in, for example, A. E. Martell and R. M. Smith, "Critical Stability Constants", Vol. 4 and 5, Plenum Press. Some illustrative examples of the complexing compounds include salts of aminocarboxylic acids, imidinoacetic acids, pyridylcarboxylic acids, aminophosphoric acids, carboxylic acids (including mono-, di-, tri-, and tetracarboxylic acids with or without such a substituent as phosphono, hydroxy, oxo, ester, amide, alkoxy, mercapto, alkylthio, phosphino, etc.), hydroxamic acids, polyacrylic acids, and polyphosphoric acids with alkali metals, guanidines, amidines, and quaternary ammonium. It is advantageous to separately add the difficultly soluble metal compound and the complexing compound to the photosensitive material and the dye-fixing material, respectively, or vice verse.

In the practice of the present invention, a variety of development inhibitors may be used in the photosensitive element and/or dye-fixing element for the purpose of obtaining a consistent image irrespective of variations in treating temperature and time during heat development. By the development inhibitor is meant those compounds capable of, immediately after development has proceeded to an optimum extent, neutralizing or reacting with a base to reduce its concentration in the film to inhibit development, or those compounds capable of, immediately after optimum development, interacting with silver or silver salt to retard development. Illustrative examples are acid precursors capable of releasing acid upon heating, electrophilic compounds capable of substitution reaction with a coexisting base upon heating, nitrogen-containing heterocyclic compounds, mercapto compounds and their precursors, and the like. Specific examples are disclosed in Japanese Patent Application Nos. 58-216928, 59-48305, 59-85834, and 59-85836.

Also useful are those compounds which release mercapto compounds upon heating, for example, those described in the following Japanese Patent Applications.

| | | |
|---|---|---|
| 59-190173 | 59-268926 | 59-246468 |
| 60-26038 | 60-22602 | 60-26039 |
| 60-24665 | 60-29892 | 59-176350 |

Further, in the present invention, it is possible to use a compound which activates development simultaneously with stabilizing the image. Particularly preferred compounds used herein are those described in U.S. Pat. No. 4,500,626, columns 51–52.

A variety of anti-fogging agents may be used in the practice of the present invention. Preferred anti-fogging agents are azoles and azaindenes as disclosed in Research Disclosure, December 1978, pages 24-25, nitrogen-containing carboxylic acids and phosphoric acids as described in Japanese Patent Application Kokai No. 59-168442, mercapto compounds and metals salts thereof as described in Japanese Patent Application Kokai No. 59-111636, and acetylene compounds as described in Japanese Patent Application No. 60-228267.

The photosensitive material used in the practice of the present invention may contain a toning agent if desired. Useful toning agents are those described in Japanese Patent Application No. 59-268926, pages 92-93.

The binders employed in the photosensitive material in the practice of the present invention may be hydrophilic. The typical hydrophilic binder is a transparent or translucent hydrophilic binder, examples of which include natural substances, for example, proteins such as gelatin, gelatin derivatives and cellulose derivatives and polysaccharides such as starch, gum arabic, etc.; and synthetic polymers, for example, water-soluble polyvinyl compounds such as polyvinyl pyrrolidone, acrylamide polymer, etc. Another example of the synthetic polymer compound is a dispersed vinyl compound in a latex form which is used for the purpose of increasing the dimensional stability of a photographic material. These binders may be used alone or in admixture. The binders may be coated in amounts of up to 20 grams per square meter, preferably up to 10 grams per square meter, and most preferably up to 7 grams per square meter.

The high-boiling organic solvent may be dispersed in the binder together with hydrophobic compounds, for example, a dye-providing substance such that the volume of the solvent is less than about 1 cc, preferably less than about 0.5 cc, and most preferably less than about 0.3 cc per gram of the binder.

Any of the layers of the heat-developable photosensitive material and the dye-fixing material according to the present invention, including photographic emulsion, dye-fixing and other layers, may contain inorganic or organic hardeners. Illustrative examples of the hardeners are those set forth in Japanese Patent Application No. 59-268926, pages 94–95, and Japanese Patent Application Kokai No. 59-157636, page 38. They may be used alone or in combination.

The support suitable for use in the photosensitive material and optional dye-fixing material according to the present invention must withstand the processing temperature. Exemplary of ordinary supports there may be given not only glass, paper, polymer film, metal and analogues, but also those described as supports in Japanese Patent Application No. 59-268926, pages 95–96.

Where the photosensitive material of the present invention contain a colored dye-providing substance, it is not necessarily required for the photosensitive material to further contain an anti-irradiation or anti-halation agent or dye. If desired, a filter dye or absorbing material may be contained as described in Japanese Patent Application No. 59-268926, pages 97–98 and U.S. Pat. No. 4,500,626, col. 55, lines 41–52.

In order to provide a wide range of color within the chromaticity diagram using the three primary colors, yellow, magenta and cyan, the photosensitive elements used in the present invention should include at least three silver halide emulsion layers having sensitivity in different spectra. Combinations of three layers, typically blue-, green-, and red-sensitive layers, and green-, red-, and infrared-sensitive layers are contemplated herein. Typical combinations of at least three photosensitive silver halide emulsion layers having sensitivity in different spectra are described in Japanese Patent Application Kokai No. 59-180550. One photosensitive emulsion layer having sensitivity in a certain spectrum may be divided into two or more sublayers, depending on the sensitivity of emulsion, if desired.

The photosensitive elements used in the practice of the present invention may further contain any of various additives well known for use in heat-developable photosensitive elements and possess in addition to the photosensitive layers, any layers including a protective layer, intermediate layer, antistatic layer, electroconductive layer, antihalation layer, release layer for facilitating separation from a dye-fixing element, and matte agent layer.

Exemplary of the additives there may be given plasticizers, matte agents, sharpness improving dyes, antihalation dyes, sensitizing dyes, surface-active agents, brighteners, UV absorbers, anti-sliding agents, antioxidants, anti-discoloration agents, etc. as described in Research Disclosure, Vol. 170, June 1978, No. 17029, and Japanese Patent Application No. 59-209563. More specifically, the protective layer or coat (PC) usually contains an organic or inorganic matte agent for adherence prevention. The protective layer may futher contain a mordant, a UV absorber, etc. Each of the protective and intermediate layers may be comprised of two or more layers.

The intermediate layer may contain a reducing agent for preventing discoloration or color mixing, a UV absorber, and a white pigment such as titanium dioxide. The white pigment may be added not only to the intermediate layer, but also to the emulsion layers for the purpose of increasing sensitivity.

The photographic element according to the present invention may be comprised of a photosensitive element which forms or releases a dye through heat development and optionally, a dye-fixing element which fixes the dye.

Particularly, systems of forming an image through diffusion transfer of a dye need the photosensitive and dye-fixing elements as requisite elements. They are generally classified into two typical forms, one form having photosensitive and dye-fixing layers separately applied on two separate suppotts and another form having both photosensitive and dye-fixing layers applied on a common support. With respect to the relation of the photosensitive element and the dye-fixing element to one another, to the support, and to a white reflective layer, reference may be made to the descriptions of Japanese Patent Application No. 59-268926, pages 58–59 and U.S. Pat. No. 4,500,626, col. 57.

A typical system having both photosensitive and dye-fixing elements applied on a common support is one wherein the photosensitive element need not be peeled from the image-receiving element after formation of a transfer image. In this case, a photosensitive layer, a dye-fixing layer, and a white reflective layer are laminated on a transparent or opaque support. The preferred arrangements are transparent support/photosensitive layer/white reflective layer/dye-fixing layer and transparent support/dye-fixing layer/white reflective layer/photosensitive layer, to name a few.

Another typical form having both photosensitive and dye-fixing elements applied on a common support is one wherein a release layer is applied at a proper location such. that the photosensitive element may be entirely or partially separated from the dye-fixing element, as disclosed in Japanese Patent Application Kokai No. 56-67840, Canadian Pat. No. 674,082, and U.S. Pa. No. 3,730,718.

The photosensitive element and/or dye-fixing element according to the present invention may have an electroconductive heating element layer serving as heating means for heat development or diffusion transfer of dye. Such a transparent or opaque heating element may be provided in the form of a resistance heating element using a conventional well-known technique. The resistance heating element may be prepared by utilizing a thin film of a semiconductive inorganic material or an organic thin film of conductive fine particles dispersed in a binder. The materials which can be used in these methods are described in Japanese Patent Application No. 59-151815.

The dye-fixing element preferably used in the present invention has at least one layer containing a mordant. Where the dye-fixing layer is positioned at the surface, a protective layer may be provided thereon if necessary. The dye-fixing element, particularly with respect to its layer arrangement, binder, additives, and location of a mordant-containing layer, is described in Japanese Patent Application No. 59-268926, pages 62–63 and the patent specifications cited therein, which are incorporated herein by reference.

The dye-fixing element may optionally be provided with any auxiliary layers, for example, a release layer, matte agent layer, and anti-curling layer, in addition to the above-mentioned layers. One or more of these layers may contain a base and/or base precursor for promoting dye transfer, hydrophilic thermal solvent, plasticizer, anti-discoloration agent, UV absorber, anti-sliding agent, matte agent, antioxidant, dispersed vinyl compound for increasing dimensional stability, surface-active agent, brightener, etc. Illustrative examples of these additives are described in Research Disclosure, Vol. 170, June 1978 (RD 17029) and Japanese Patent Application No. 59-209563, pages 101–120.

The binders in the above-mentioned layers are preferably hydrophilic, and a typical binder is a transparent or translucent hydrophilic colloid. Illustrative examples are those previously enumerated for the photosensitive material.

The image-receiving layer used in the present invention is a dye-fixing layer which is commonly used in a heat-developable color photosensitive material and contains a mordant selected from commonly used ones. Preferred mordants are polymeric mordants. The polymeric mordants include polymers containing a tertiary amino group, polymers having a nitrogen-containing heterocyclic moiety, and polymers containing a quaternary cationic group. Examples are described in Japanese Patent Application No. 59-268926, pages 98–100 and U.S. Pat. No. 4,500,626, columns 57–60.

In the practice of the present invention, the heat-developable photosensitive, protective, intermediate, undercoat, backcoat, dye-fixing, and other layers may be applied by any conventional coating methods, typically, the method described in U.S. Patent No. 4,500,626, columns 55-56.

The light source for image exposure to record an image in the heat-developable light-sensitive element may be any radiation including visible light. In general, light sources used in ordinary color printing may be used as set forth in Japanese Patent Application No. 59-268926, page 100 and U.S. Pat. No. 4,500,626, col. 56.

The heating temperature used in the heat development step generally ranges from about 50° C. to about 250° C., preferably from about 80° C. to about 180° C. Where a dye transfer step is carried out after completion of a heat development step, the heating temperature used in the transfer step may range from room temperature to the temperature used in the heat development to enable dye transfer, more preferably from 50° C. to a temperature which is about 10° C. lower than the temperature used in the heat development. Heating means used in the development and/or transfer step include heat blocks, irons, heat rollers, and heating elements using carbon and titanium white, but not limited thereto.

In one preferred mode of the image forming process, a heat-developable photosensitive material is heated in the presence of a minor amount of solvent, typically water to concurrently or sequentially conduct development and transfer. In this mode, the above-mentioned image formation promotor may be previously contained in the dye-fixing material and/or photosensitive material. he mode of concurrently or sequentially carrying out development and transfer prefers a heating temperature in the range from 50° C. up to the boiling point of the solvent, for example, from 50° C. to 100° C. for water solvent.

A solvent may also be used in order to allow the mobile dye to migrate to the dye-fixing layer.

Examples of the solvents used to provide for promotion of development and/or migration of a mobile dye to the dye-fixing layer are water and aqueous basic solutions containing inorganic alkali metal salts and organic bases, with the bases being selected from those previously described in conjunction with the image formation promotor. Also useful are low-boiling solvents and mixtures of low-boiling solvents and water or aqueous basic solutions. Such additives as surface-active agent, anti-fogging agent, and difficultly soluble metal salt-complexing agent combination may be contained in the solvent.

These solvents may be applied to the dye-fixing material and/or photosensitive material. The amount of solvent used is as small as up to the weight of solvent corresponding to the maximum swollen volume of the overall coatings, more specifically up to the weight of solvent corresponding to the maximum swollen volume of the overall coatings minus the weight of the overall coatings.

The solvent, typically water is applied between a photosensitive layer of a heat-developable photosensitive material and a dye-fixing layer of a dye-fixing material in order to promote formation of an image and/or migration of a dye, and it may be incorporated in either the photosensitive and/or dye-fixing layer. A suitable method for providing the solvent to the photosensitive or dye-fixing layer is described in Japanese Patent Application No. 59-268926, pages 101–102, for example.

To promote dye transfer, the photosensitive material or dye-fixing material may contain therein a hydrophilic thermal solvent which is solid at an ambient temperature, but melts at elevated temperatures to serve as solvents. The hydrophilic thermal solvent may be incorporated in the photosensitive element and/or the dye-fixing element. Although the solvent can be incorporated into any of the emulsion layer, intermediate layer, protective layer, and dye-fixing layer, it is preferred to incorporate it into the dye-fixing layer and/or layers adjacent thereto. Examples of the hydrophilic thermal solvents include ureas, pyridines, amides, sulfonamides, imides, alcohols, oximes and other heterocyclic compounds.

Heating means used during the transfer step in the practice of the present invention may be any of the means described in Japanese Patent Application No. 59-268926, pages 102–103. It is also possible to provide the dye-fixing material with a layer of electroconductive material such as graphite, carbon black, and metal whereby electric current is conducted to the conductive layer to directly heat the material.

The pressure under which the photosensitive and dye-fixing materials are in firm contact and application of such. pressure may be in accord with the method described in Japanese Patent Application No. 59-268926, pages 103–104.

Because of the presence of a compound having general formula (I) or (II) or a polymer having monomer units of general formula (III), the heat-developable photosensitive material of the present invention can produce a dye image having a high density, less color turbidity, high color reproducibility, and less fog through heat development within a short time and is stable over an extended shelf storage. This is because the compound according to the present invention has an improved shelf stability, causes little fog with a lapse of time when added to an emulsion layer, and exhibits a substantial development promoting effect during development.

EXAMPLES

In order that those skilled in the art may better understand how the present invention may be practiced, the following examples are given by way of illustration and not by way of limitation.

EXAMPLE 1

Preparation of Silver Benzotriazole Emulsion

A silver benzotriazole emulsion was prepared by dissolving 28 grams of gelatin and 13.2 grams of benzotriazole in 300 ml of water. The resulting solution was agitated at 40° C. A solution of 17 grams silver nitrate in 100 ml water was added to the solution over a period of 2 minutes.

The resulting silver benzotriazole emulsion was adjusted to such pH that an excess salt precipitated, and the excess salt was filtered off. The emulsion was then adjusted to pH 6.30, obtaining a silver benzotriazole emulsion in a yield of 400 grams.

Preparation of Silver Halide Emulsion

A silver halide emulsion used in first and fifth layers was prepared as follows.

An aqueous gelatin solution was prepared by dissolving 20 grams of gelatin and 3 grams of sodium chloride in 1000 ml of water and kept at a temperature of 75° C. While fully agitating the gelatin solution, 600 ml of an aqueous solution of sodium chloride and potassium bromide and another aqueous solution of 0.59 mols of silver nitrate in 600 ml of water were concurrently added to the gelatin solution at an equal flow rate over a period of 40 minutes. In this way, there was prepared a monodispersed cubic silver chlorobromide emulsion having an average grain size of 0.40 μm (bromine 50 mol %).

After rinsing with water and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

A silver halide emulsion used in a third layer was prepared as follows.

An aqueous gelatin solution was prepared by dissolving 20grams of gelatin and 3 grams of sodium chloride in 1000 ml of water and kept at a temperature of 75° C. While fully agitating the gelatin solution, 600 ml of an aqueous solution of sodium chloride and potassium bromide and another aqueous solution of 0.59 mols of silver nitrate in 600 ml of water were concurrently added to the gelatin solution at an equal flow rate over a period of 40 minutes. In this way, there was prepared a monodispersed cubic silver chlorobromide emulsion having an average grain size of 0.35 μm (bromine 80 mol %).

After water rinsing and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

Next, a dispersion of a dye-providing substance in gelatin was prepared as follows.

Preparation of Gelatin Dispersion of Dye-Providing Substance

Five (5) grams of yellow dye-providing substance (A) having the formula shown below was dissolved together with 0.5 grams of succinic acid-2-ethylhexyl ester sodium sulfonate and 10 grams of triisononyl phosphate in 30 ml of ethyl acetate by heating at about 60° C., obtaining a homogeneous solution. The solution was mixed with 100 grams of a 10 wt % lime-treated gelatin solution by agitation, and the mixture was dispersed with a homogenizer for 10 minutes at 10,000 rpm. This dispersion is called yellow dye-providing substance dispersion.

A magenta dye-providing substance dispersion was prepared by the same procedure as above except that a magenta dye-providing substance (B) was used as the dye-providing substance and 7.5 grams of tricresyl phosphate was used as the high boiling solvent.

A cyan dye-providing substance dispersion was prepared by the same procedure as above except that a cyan dye-providing substance (C) was used as the dye-providing substance.

Using these preparations, there was prepared a color light-sensitive material No. 101 of multi-layer structure as shown in the following formulation:

[FORMULATION]

Sixth layer
- gelatin (coating weight 800 mg/m$^2$)
- hardener*3 (coating weight 16 mg/m$^2$)
- silica*5 (coating weight 100 mg/m$^2$)

Fifth layer: Green-sensitive emulsion layer
- silver chlorobromide emulsion (bromine 50 mol %, coating weight 400 mg/m$^2$ of Ag)
- silver benzotriazole emulsion (coating weight 100 mg/m$^2$ of Ag)
- sensitizing dye D-1 (coating weight $10^{-6}$ mol/m$^2$)
- hardener*3 (coating weight 16 mg/m$^2$)
- antifoggant*6 (coating weight 13 mg/m$^2$)
- yellow dye-providing substance (A) (coating weight 400 mg/m$^2$)
- gelatin (coating weight 1000 mg/m$^2$)
- high-boiling solvent*4 (coating weight 800 mg/m$^2$)
- surface-active agent*2 (coating weight 100 mg/m$^2$)

Fourth layer: Intermediate layer
- gelatin (coating weight 900 mg/m$^2$)
- hardener*3 (coating weight 18 mg/m$^2$)
- zinc hydroxide (coating weight 600 mg/m$^2$)

Third layer: Red-sensitive emulsion layer
- silver chlorobromide emulsion (bromine 80 mol %, coating weight 300 mg/m$^2$ of Ag)
- silver benzotriazole emulsion (coating weight 100 mg/m$^2$ of Ag)
- sensitizing dye D-2 (coating weight $8\times10^{-7}$ mol/m$^2$)
- hardener*3 (coating weight 18 mg/m$^2$)
- antifoggant*6 (coating weight 13 mg/m$^2$)
- magenta dye-providing substance (B) (coating weight 400 mg/m$^2$)
- gelatin (coating weight 1000 mg/m$^2$)
- high-boiling solvent*1 (coating weight 600 mg/m$^2$)
- surface-active agent*2 (coating weight 100 mg/m$^2$)

Second layer: Intermediate layer
- gelatin (coating weight 800 mg/m$^2$)
- hardener*3 (coating weight 16 mg/m$^2$)
- zinc hydroxide (coating weight 400 mg/m$^2$)

First layer: Infrared-sensitive emulsion layer
- silver chlorobromide emulsion (bromine 50 mol %, coating weight 300 mg/m$^2$ of Ag)
- silver benzotriazole emulsion (coating weight 100 mg/m$^2$ of Ag)
- sensitizing dye D-3 (coating weight $10^{-8}$ mol/m$^2$)
- hardener*3 (coating weight 16 mg/m$^2$)
- antifoggant*6 (coaiing weight 13 mg/m$^2$)
- cyan dye-providing substance (C) (coating weight 300 mg/m$^2$)
- gelatin (coating weight 1000 mg/m$^2$)
- high-boiling solvent*4 (coating weight 600 mg/m$^2$)
- surface-active agent 2 (coating weight 100 mg/m$^2$)

Support

*1 tricresyl phosphate

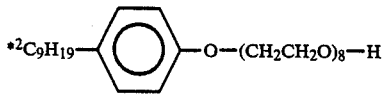

*3 1,2-bis(vinylsulfonylacetamide)ethane
*4 (iso-$C_9H_{19}O)_3P{=}O$
*5 size 4 μm

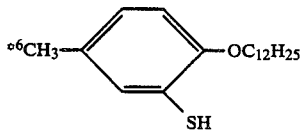

Dye-providing substance (A)

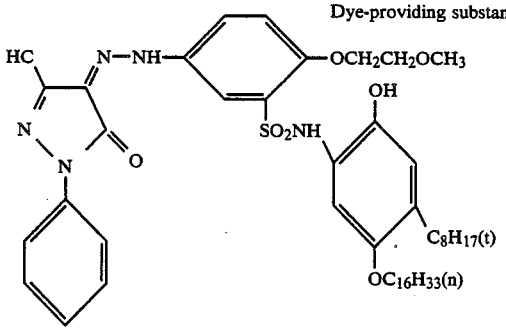

Dye-providing substance (B)

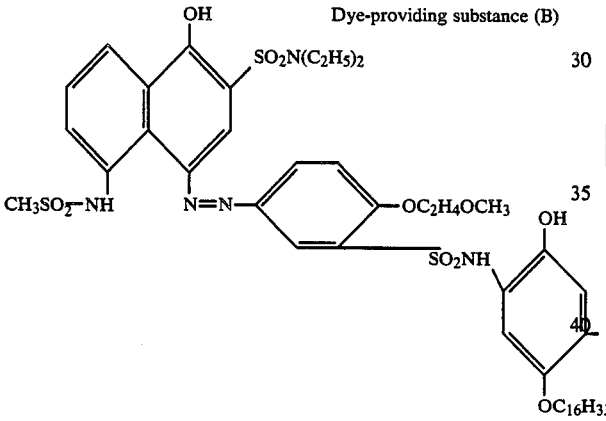

Dye-providing substance (C)

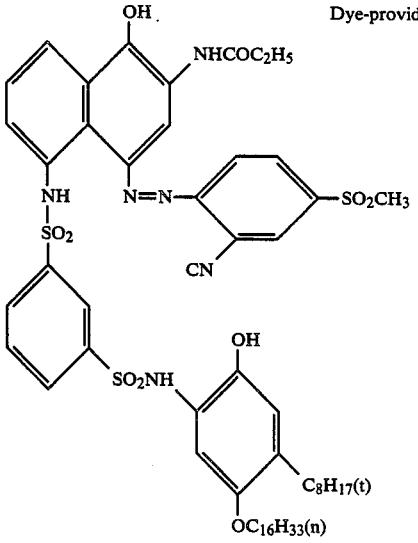

-continued

Sensitizing dye (D-1)

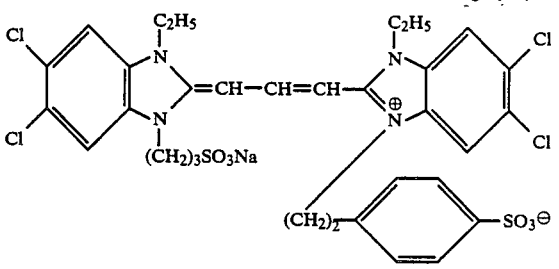

Sensitizing dye (D-2)

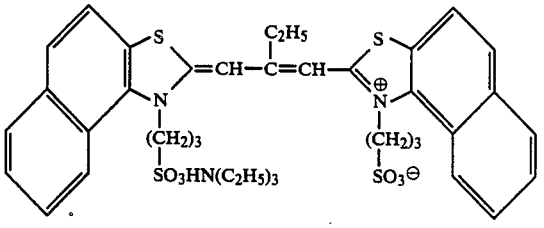

Sensitizing dye (D-3)

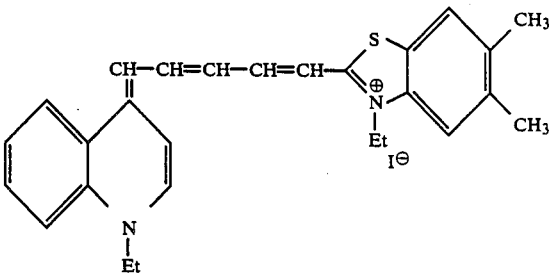

Photosensitive material Nos. 102 to 106 were similarly prepared by incorporating compounds according to the present invention into each of the dye-providing substance gelatin dispersions as shown in Table 1.

Next, the preparation of a dye-fixing material will be described.

Preparation of Dye-Fixing Material

In 130 ml of water was dissolved 9 grams of a polymer having the structure as defined below. The solution was homogeneously mixed with 50 grams of 10 wt % lime-treated gelatin, 5 grams of dextran having an average molecular weight of 59,000, and 7.6 grams of guanidine picolinate. The resulting mixture was uniformly spread onto a paper substrate laminated with polyethylene having titanium dioxide dispersed therein, thereby forming a dye-fixing layer having a uniform wet thickness of 55 μm, which was then dried.

Separately, 1.5 grams of gelatin hardener H-1, 0.5 grams of gelatin hardener H-2, 130 ml of water, and 70 grams of 10% lime-treated gelatin were evenly mixed. The mixture was uniformly coated on the layer to a wet film thickness of 20 μm. After drying, there was obtained a dye-fixing material designated K-1.

Polymer structure:

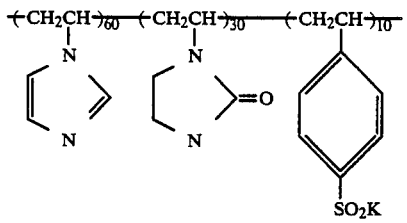

Gelatin hardener H-1:

$CH_2{=}CHSO_2CH_2CONHCH_2CH_2NHCOCH_2SO_2CH{=}CH_2$

Gelatin hardener H-2:

$CH_2{=}CHSO_2CH_2CONHCH_2CH_2CH_2NHCOCH_2SO_2CH{=}CH_2$

Multilayered color light-sensitive material Nos. 101–106 were exposed for one second at 500 lux under a tungsten lamp through three color separation filters G, R, and IR having a continuously varying density. It should be noted that filter G is a 500–600 nm band pass filter, filter R is a 600–700 nm band pass filter, and filter IR is a filter transmitting light having wavelengths of at least 700 nm.

Water was applied by means of a wire bar in an amount of 20 ml per square meter to the emulsion surface of the thus exposed light-sensitive material, which was superimposed on the dye-fixing material K-1 such that their effective surfaces faced one another. After heating for 20 seconds through heat rollers at such a temperature such that the temperature of the wet film reached 90° to 95° C., the dye-fixing material was peeled from the light-sensitive material. The dye-fixing material then bore thereon clear images of yellow (Y), magenta (M), and cyan (C) corresponding to the three color separation filters. The maximum density (Dmax) and minimum density (Dmin) of the respective color images were measured by means of a Macbeth (RD-519) reflection densitometer. The results are shown in Table 1.

TABLE 1

| Photo-sensitive material | Compound No. | Amount* (g) | | Maximum Density | Minimum Density |
|---|---|---|---|---|---|
| 101 (control) | — | — | Yellow | 1.32 | 0.12 |
| | | | Magenta | 1.40 | 0.12 |
| | | | Cyan | 1.49 | 0.12 |
| 102 | 1 | 0.25 | Yellow | 1.83 | 0.13 |
| | | | Magenta | 1.91 | 0.12 |
| | | | Cyan | 1.98 | 0.12 |
| 103 | 3 | 0.30 | Yellow | 1.80 | 0.13 |
| | | | Magenta | 1.92 | 0.13 |
| | | | Cyan | 1.96 | 0.12 |
| 104 | 6 | 0.25 | Yellow | 1.77 | 0.13 |
| | | | Magenta | 1.88 | 0.13 |
| | | | Cyan | 1.90 | 0.12 |
| 105 | 37 | 0.20 | Yellow | 1.86 | 0.14 |
| | | | Magenta | 1.95 | 0.12 |
| | | | Cyan | 1.93 | 0.12 |
| 106 | 49 | 0.25 | Yellow | 1.80 | 0.13 |
| | | | Magenta | 1.90 | 0.13 |
| | | | Cyan | 1.96 | 0.12 |

*per 5 grams of dye-providing substance.

As seen from Table 1, the compounds according to the present invention are effective in producing images having a high density and less fog.

Photosensitive material Nos. 101 to 106 were shelf aged for 7 days at 40° C. and 70% RH and then processed in the same manner as above to fine that the images associated with material Nos. 102 to 106 had substantially the same maximum and minimum densities as reported in Table 1 although material No. 101 resulted in an increased minimum density of 0.24 for Yellow, 0.23 for Magenta, and 0.26 for Cyan.

EXAMPLE 2

Color photosensitive material Nos. 201 to 206 were prepared by coating a polyethylene terephthalate film support with a first layer (lowermost layer) to a sixth layer (uppermost layer) as shown in the following formulation.

The emulsions, dye-providing substance dispersions, and sensitizing dyes used are the same as described in Example 1.

[FORMULATION]

Sixth layer
- gelatin (coating weight 1000 mg/m$^2$)
- base precursor*3 (coating weight 600 mg/m$^2$)
- hardener*6 (coating weight 100 mg/m$^2$)
- silica*5 (coating weight 100 mg/m$^2$)

Fifth layer: Green-sensitive emulsion layer
- silver chlorobromide emulsion (bromine 50 mol %, coating weight 400 mg/m$^2$ of Ag)
- benzene sulfonamide (coating weight 180 mg/m$^2$)
- silver benzotriazole emulsion (coating weight 100 mg/m$^2$ of Ag)
- sensitizing dye D-1 (coating weight $10^{-6}$ mol/m$^2$)
- base precursor*3 (coating weight 500 mg/m$^2$)
- antifoggant*7 (coating weight 13 mg/m$^2$)
- yellow dye-providing substance (A) (coating weight 400 mg/m$^2$)
- gelatin (coating weight 1000 mg/m$^2$)
- high-boiling solvent*4 (coating weight 800 mg/m$^2$)
- surface-active agent*2 (coating weight 100 mg/m$^2$)

Fourth layer: Intermediate layer
- gelatin (coating weight 1200 mg/m$^2$)
- base precursor*3 (coating weight 600 mg/m$^2$)

Third layer: Red-sensitive emulsion layer
- silver chlorobromide emulsion (bromine 80 mol %, coating weight 300 mg/m$^2$ of Ag)
- benzene sulfonamide (coating weight 180 mg/m$^2$)
- silver benzotriazole emulsion (coating weight 100 mg/m$^2$ of Ag)
- sensitizing dye D-2 (coating weight $8\times10^{-7}$ mol/m$^2$)
- base precursor*3 (coating weight 450 mg/m$^2$)
- antifoggant*7 (coating weight 13 mg/m$^2$)
- magenta dye-providing substance (B) (coating weight 400 mg/m$^2$)
- gelatin (coating weight 1000 mg/m$^2$)
- high-boiling solvent*1 (coating weight 600 mg/m$^2$)
- surface-active agent*2 (coating weight 100 mg/m$^2$)

Second layer: Intermediate layer
- gelatin (coating weight 1000 mg/m$^2$)
- base precursor*3 (coating weight 600 mg/m$^2$)

First layer: Infrared-sensitive emulsion layer
- silver chlorobromide emulsion (bromine 50 mol %, coating weight 300 mg/m$^2$ of Ag)
- benzene sulfonamide (coating weight 180 mg/m$^2$)
- silver benzotriazole emulsion (coating weight 100 mg/m$^2$ of Ag)
- sensitizing dye D-3 (coating weight $10^{-8}$ mol/m$^2$)
- base precursor*3 (coating weight 500 mg/m$^2$)

antifoggant*7 (coating weight 13 mg/m²)
cyan dye-providing substance (C) (coating weight 300 mg/m²)
gelatin (coating weight 1000 mg/m²)
high-boiling solvent*4 (coating weight 600 mg/m²)
surface-active agent*2 (coating weight 100 mg/m²)
Support

*1 tricresyl phosphate

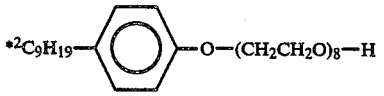

*3 guanidine p-chlorophenylsulfonylacetate
*4 $(iso\text{-}C_9H_{19}O)_3P{=}O$
*5 size 4 μm
*6 1,2-bis(vinylsulfonylacetamide)ethane

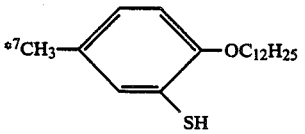

A dye-fixing material having an image-receiving layer was prepared.

First, 10 grams of poly(methyl acrylate-co-N,N,N-trimethyl-N-vinylbenzyl ammonium chloride) having a ratio of methyl acrylate to vinylbenzyl ammonium chloride of 1:1 was dissolved in 200 ml of water and then combined with 100 grams of 10% lime-treated gelatin. The mixture was evenly spread on a paper substrate laminated with polyethylene having titanium dioxide dispersed therein, thereby forming a layer having a uniform wet thickness of 90 μm. Drying resulted in a dye-fixing material having a mordant layer.

Photosensitive material Nos. 201 to 206 were exposed to light in the same manner as in Example 1 and then heated for 20 seconds on a heat block at a temperature of 150° C.

Water was applied to the layer surface of the dyefixing material in an amount of 20 ml per square meter. At the end of heating, the photosensitive material was superimposed on the wet dye-fixing material such that their effective surfaces faced one another. After heating for 6 seconds on a heat block at 80° C., the dye-fixing material was peeled from the photosenstitive material. The dye-fixing material then bore thereon clear images of yellow (Y), magenta (M), and cyan (C) corresponding to the three color separation filters. The maximum and minimum densities of the respective color images were measured by means of a Macbeth (RD-519) reflection densitometer. The results are shown in Table 2.

TABLE 2

| Photo-sensitive material | Compound No. | Amount* (g) | | Maximum Density | Minimum Density |
|---|---|---|---|---|---|
| 201 (control) | — | — | Yellow | 1.80 | 0.16 |
| | | | Magenta | 1.90 | 0.15 |
| | | | Cyan | 1.88 | 0.16 |
| 202 | 1 | 0.25 | Yellow | 2.05 | 0.14 |
| | | | Magenta | 2.30 | 0.13 |
| | | | Cyan | 2.35 | 0.14 |
| 203 | 3 | 0.30 | Yellow | 2.00 | 0.14 |
| | | | Magenta | 2.21 | 0.14 |
| | | | Cyan | 2.30 | 0.14 |
| 204 | 6 | 0.25 | Yellow | 1.98 | 0.12 |
| | | | Magenta | 2.08 | 0.13 |
| | | | Cyan | 2.22 | 0.13 |
| 205 | 37 | 0.20 | Yellow | 2.08 | 0.14 |
| | | | Magenta | 2.32 | 0.13 |
| | | | Cyan | 2.20 | 0.14 |
| 206 | 49 | 0.25 | Yellow | 1.95 | 0.13 |
| | | | Magenta | 2.10 | 0.13 |
| | | | Cyan | 2.25 | 0.14 |

*per 5 grams of dye-providing substance.

As seen from Table 2, the compounds according to the present invention are effective in producing images having a high density and less fog.

Photosensitive material Nos. 201 to 206 were shelf aged for 7 days at 40° C. and 70% RH and then processed in the same manner as above. It was found that the resulting images on pphotosensitive material Nos. 202 to 206 had substantially the same maximum and minimum densities as reported in Table 2 although photosensitive material No. 201 showed an increased minimum density of 0.22 for Yellow, 0.18 for Magenta and 0.25 for Cyan.

EXAMPLE 3

Preparation of Silver Halide Emulsion

A silver halide emulsion used in a first layer was prepared as follows.

An aqueous gelatin solution was prepared by dissolving 20 grams of gelatin and 3 grams of sodium chloride in 1000 ml of water and kept at a temperature of 75° C. While fully agitating the gelatin solution, 600 ml of an aqueous solution of sodium chloride and potassium bromide and another aqueous solution of 0.59 mols of silver nitrate in 600 ml of water were concurrently added to the gelatin solution at an equal flow rate over a period of 40 minutes. In this way, there was prepared a monodispersed cubic silver chlorobromide emulsion having an average grain size of 0.35 μm (bromine 80 mol %).

After rinsing with water and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

A silver halide emulsion used in a third layer was prepared as follows.

An aqueous gelatin solution was prepared by dissolving 20 grams of gelatin and 3 grams of sodium chloride in 1000 ml of water and kept at a temperature of 75° C. While fully agitating the gelatin solution, 600 ml of an aqueous solution of sodium chloride and potassium bromide, another aqueous solution of 0.59 mols of silver nitrate in 600 ml of water, and a dye solution (1) as defined below were concurrently added to the gelatin solution at an equal flow rate over a period of 40 minutes. In this way, there was prepared a monodispersed cubic silver chlorobromide emulsion having an average grain size of 0.35 μm (bromine 80 mol %).

After water rinsing and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

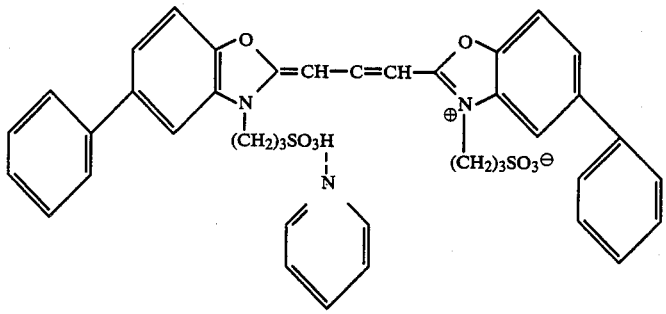

160 mg

Methanol 400 ml

A silver halide emulsion used in a fifth layer was prepared as follows.

An aqueous gelatin solution was prepared by dissolving 20 grams of gelatin and ammonia in 1000 ml of water and kept at a temperature of 50° C. While fully agitating the gelatin solution, 1000 ml of an aqueous solution of potassium iodide and potassium bromide and another aqueous solution of 1 mol of silver nitrate in 1000 ml of water were concurrently added to the gelatin solution while maintaining the pAg of the solution constant. In this way, there was prepared a monodisperse octahetral silver iodobromide emulsion having an average grain size of 0.5 μm (iodine 5 mol %).

After rinsing with water and desalting, 5 mg of chloroauric acid tetrahydrate and 2 mg of sodium thiosulfate were added to effect gold and sulfur sensitization at 60° C. There was obtained an emulsion in a yield of 1000 grams.

The silver benzotriazole emulsion used and the gelatin dispersion of dye-providing substance to which an additive compound was added as shown in Table 3 were prepared in the same manner as in Example 1.

Using these preparations, there were prepared color photosensitive material Nos. 301 to 303 of multi-layer structure as shown in the following formulation.

[FORMULATION]

Sixth layer
- gelatin (coating weight 800 mg/m$^2$)
- hardener*5 (coating weight 16 mg/m$^2$)
- basic zinc carbonate (coating weight 500 mg/m$^2$)

Fifth layer: Blue-sensitive emulsion layer
- silver iodobromide emulsion (iodine 5 mol %, coating weight 400 mg/m$^2$ of Ag)
- antifoggant*6 (coating weight 13 mg/m$^2$)
- silver benzotriazole emulsion (coating weight 100 mg/m$^2$ of Ag)
- hardener*5 (coating weight 16 mg/m$^2$)
- yellow dye-providing substance (A) (coating weight 400 mg/m$^2$)
- gelatin (coating weight 1000 mg/m$^2$)
- high-boiling solvent*4 (coating weight 800 mg/m$^2$)
- surface-active agent*2 (coating weight 100 mg/m$^2$)

Fourth layer: Intermediate layer
- gelatin (coating weight 900 mg/m$^2$)
- hardener*5 (coating weight 18 mg/m$^2$)
- basic zinc carbonate (coating weight 400 mg/m$^2$)

Third layer: Green-sensitive emulsion layer
- silver chlorobromide emulsion (bromine 80 mol %, coating weight 300 mg/m$^2$ of Ag)
- antifoggant*6 (coating weight 13 mg/m$^2$)
- silver benzotriazole emulsion (coating weight 100 mg/m of Ag)
- hardener*5 (coating weight 18 mg/m$^2$)
- magenta dye-providing substance (B) (coating weight 400 mg/m$^2$)
- gelatin (coating weight 1000 mg/m$^2$)
- high-boiling solvent*1 (coating weight 600 mg/m$^2$)
- surface-active agent*2 (coating weight 100 mg/m$^2$)

Second layer: Intermediate layer
- gelatin (coating weight 800 mg/m$^2$)
- hardener*5 (coating weight 16 mg/m$^2$)
- basic zinc carbonate (coating weight 450 mg/m$^2$)

First layer: Red-sensitive emulsion layer
- silver chlorobromide emulsion (bromine 80 mol %, coating weight 300 mg/m$^2$ of Ag)
- antifoggant*6 (coating weight 13 mg/m$^2$)
- silver benzotriazole emulsion (coating weight 100 mg/m$^2$ of Ag)
- sensitizing dye*3 (coating weight $8\times10^{-7}$ mol/m$^2$)
- cyan dye-providing substance (C) (coating weight 300 mg/m$^2$)
- gelatin (coating weight 1000 mg/m$^2$)
- high-boiling solvent*4 (coating weight 450 mg/m$^2$)
- surface-active agent*2 (coating weight 100 mg/m$^2$)
- hardener*5 (coating weight 16 mg/m$^2$)

Support

*1 tricresyl phosphate

*2 $C_9H_{19}$—⟨benzene⟩—O—$(CH_2CH_2O)_8$—H

*3

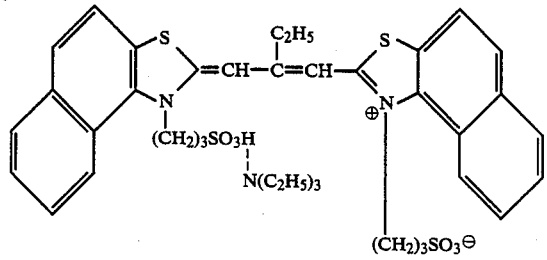

*4 (iso-$C_9H_{19}O$) 3P=O

*5 1,2-bis(vinylsulfonylacetamide)ethane

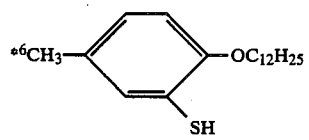

Each of the multilayered color photosensitive materials prepared as above was exposed for one second at 2000 lux under a tungsten lamp through three color separation filters B, G, and R having a continuously varying density.

Water was applied by means of a wire bar in an amount of 15 ml per square meter to the emulsion surface of the thus exposed light-sensitive material, which was superimposed on the dye-fixing material K-1 of Example 1 such that their effective surfaces faced one another. The following procedures were the same as in Example 1. The results are shown in Table 3.

Table 3 also reports the results obtained from the same photosensitive materials which were shelf stored for 7 days at 40° C. and 70% RH prior to processing in the same manner as above.

TABLE 3

| Photosensitive material | Additive agent | Amount* (g) | | Fresh Dmax | Fresh Dmin | Aged 7 days @ 40° C., 70% Dmax | Aged 7 days @ 40° C., 70% Dmin |
|---|---|---|---|---|---|---|---|
| 301 (control) | | — | Yellow | 1.78 | 0.13 | 1.77 | 0.24 |
| | | | Magenta | 1.90 | 0.12 | 1.91 | 0.22 |
| | | | Cyan | 2.01 | 0.12 | 2.03 | 0.25 |
| 302 (comparison) | Compound*7 | 0.25 | Yellow | 2.06 | 0.16 | 2.08 | 0.20 |
| | | | Magenta | 2.24 | 0.16 | 2.26 | 0.19 |
| | | | Cyan | 2.40 | 0.14 | 2.41 | 0.18 |
| 303 | Compound 1 | 0.25 | Yellow | 2.02 | 0.13 | 2.03 | 0.13 |
| | | | Magenta | 2.24 | 0.13 | 2.24 | 0.13 |
| | | | Cyan | 2.38 | 0.12 | 2.38 | 0.12 |

*per 5 grams of dye-providing susbstance.

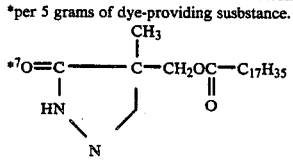

It is evident from Table 3 that the compound of the present invention is effective in producing images having a high density and less fog and excellent in shelf storage.

EXAMPLE 4

A silver acetylene dispersion was prepared by dissolving 20 grams of gelatin and 4.6 grams of 4-acetylaminophenyl acetylene in 1000 ml of water and 200 ml of ethanol. The solution was agitated at 40° C. To the solution was added 4.5 grams of silver nitrate in 200 ml of water over a period of 5 minutes. The dispersion was adjusted to such pH that an excess salt precipitated. The excess salt was filtered off, and the dispersion was adjusted to pH 6.3, obtaining a silver acetylene dispersion in a yield of 300 grams.

Photosensitive material Nos. 401 to 403 were prepared by repeating the procedure of Example 1 using the same emulsions and sensitizing dyes except that the silver benzotriazole emulsion was replaced by the above-prepared silver acetylene dispersion. The dispersion of dye-providing substance contained an additive compound as reported in Table 4.

[FORMULATION]

Sixth layer
- gelatin (coating weight 800 mg/m$^2$)
- hardener*3 (coating weight 16 mg/m$^2$)
- basic zinc carbonate (coating weight 500 mg/m$^2$)

Fifth layer: Green-sensitive emulsion layer
- silver chlorobromide emulsion (bromine 50 mol %, coating weight 500 mg/m$^2$ of Ag)
- silver acetylene emulsion (coating weight 100 mg/m$^2$ of Ag)
- sensitizing dye D-1 (coating weight $10^{-6}$ mol/m$^2$)
- hardener*3 (coating weight 16 mg/m$^2$)
- antifoggant*5 (coating weight 13 mg/m$^2$)
- yellow dye-providing substance (A) (coating weight 400 mg/m$^2$)
- gelatin (coating weight 1000 mg/m$^2$)
- high-boiling solvent*4 (coating weight 800 mg/m$^2$)
- surface-active agent*2 (coating weight 100 mg/m$^2$)

Fourth layer: Intermediate layer
- gelatin (coating weight 900 mg/m$^2$)
- hardener*3 (coating weight 18 mg/m$^2$)
- basic zinc carbonate (coating weight 400 mg/m$^2$)

Third layer: Red-sensitive emulsion layer
- silver chlorobromide emulsion (bromine 80 mol %, coating weight 400 mg/m$^2$ of Ag)
- silver acetylene emulsion (coating weight 100 mg/m$^2$ of Ag)
- sensitizing dye D-2 (coating weight $8\times10^{-7}$ mol/m$^2$)
- hardener*3 (coating weight 18 mg/m$^2$)
- antifoggant*5 (coating weight 13 mg/m$^2$)
- magenta dye-providing substance (B) (coating weight 400 mg/m$^2$)
- gelatin (coating weight 1000 mg/m$^2$)
- high-boiling solvent*1 (coating weight 600 mg/m$^2$)
- surface-active agent*2 (coating weight 100 mg/m$^2$)

Second layer: Intermediate layer
- gelatin (coating weight 800 mg/m$^2$)
- hardener*3 (coating weight 16 mg/m$^2$)
- basic zinc carbonate (coating weight 450 mg/m$^2$)

First layer: Infrared-sensitive emulsion layer
- silver chlorobromide emulsion (bromine 50 mol %, coating weight 300 mg/m$^2$ of Ag)
- silver acetylene emulsion (coating weight 80 mg/m$^2$ of Ag)
- sensitizing dye D-3 (coating weight $10^{-8}$ mol/m$^2$)
- hardener*3 (coating weight 16 mg/m$^2$)

antifoggant*5 (coating weight 13 mg/m²)
cyan dye-providing substance (C) (coating weight 300 mg/m²)
gelatin (coating weight 1000 mg/m²)
high-boiling solvent*4 (coating weight 600 mg/m²)
surface-active agent*2 (coating weight 100 mg/m²)
Support

*1 tricresyl phosphate

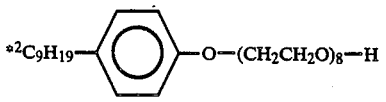

*3 1,2-bis(vinylsulfonylacetamide)ethane

*4 (iso-$C_9H_{19}O)_3P{=}O$

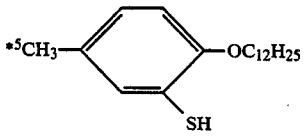

By following the same procedures as in Example 1, each of the multilayered color photosensitive materials was exposed to light and combined with dye-fixing material K-1. The results are shown in Table 4.

Table 4 also reports the results obtained from the same photosensitive materials which were shelf stored for 7 days at 40° C. and 70% RH prior to processing in the same manner as above.

TABLE 4

| Photo-sensitive material | Additive Agent | Amount* (g) | | Fresh Dmax | Fresh Dmin | Aged 7 days @ 40° C., 70% Dmax | Aged 7 days @ 40° C., 70% Dmin |
|---|---|---|---|---|---|---|---|
| 401 (control) | | — | Yellow | 1.95 | 0.13 | 1.96 | 0.26 |
| | | | Magenta | 2.02 | 0.13 | 2.04 | 0.23 |
| | | | Cyan | 2.09 | 0.12 | 2.09 | 0.26 |
| 402 (comparison) | Compound*7 | 0.25 | Yellow | 2.09 | 0.18 | 2.11 | 0.24 |
| | | | Magenta | 2.38 | 0.20 | 2.38 | 0.23 |
| | | | Cyan | 2.49 | 0.17 | 2.48 | 0.21 |
| 403 | Compound 1 | 0.25 | Yellow | 2.07 | 0.13 | 2.09 | 0.13 |
| | | | Magenta | 2.34 | 0.13 | 2.35 | 0.13 |
| | | | Cyan | 2.42 | 0.12 | 2.44 | 0.13 |

*per 5 grams of dye-providing substance.

*7

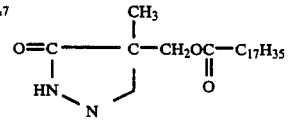

As seen from the data of Table 4, the compound of the present invention is effective in producing images having a high density and less fog and stable to shelf storage.

EXAMPLE 5

Dispersions of yellow, magenta, and cyan dye-providing substances were prepared as follows.

A solution was prepared by weighing 5 grams of a yellow dye-providing substance (X) having the formula shown below, 0.5 grams of succinic acid-2-ethylhexyl ester sodium sulfonate and 2.5 grams of triisononyl phosphate as surface-active agents, adding them to 30 ml of ethyl acetate, and heating the mixture at about 60° C. into a homogeneous solution. The solution was combined and agitated with 100 grams of a 10% lime-treated gelatin solution, and the mixture was dispersed with a homogenizer for 10 minutes at 10,000 rpm. This dispersion is called yellow dye-providing substance dispersion.

Magenta and cyan dye-providing substance dispersions were prepared by the same procedure as above except that magenta and cyan dye-providing substances (Y) and (Z) were used as the dye-providing substance.

A color photosensitive material No. 501 of multilayer structure as shown in the following formulation was prepared using these dye-providing substance dispersions, and the same silver halide emulsions, silver benzotriazole emulsion, and sensitizing dyes as used in Example 3.

(X)

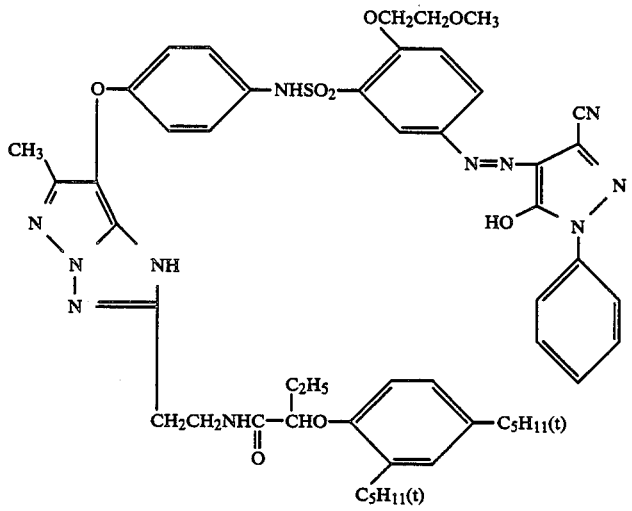

(Y)

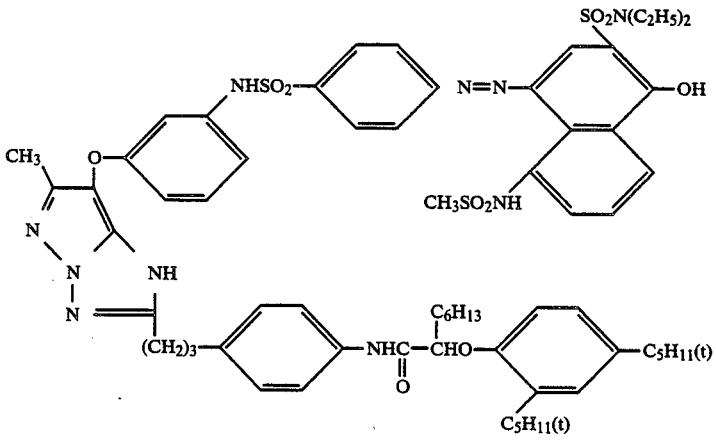

(Z)

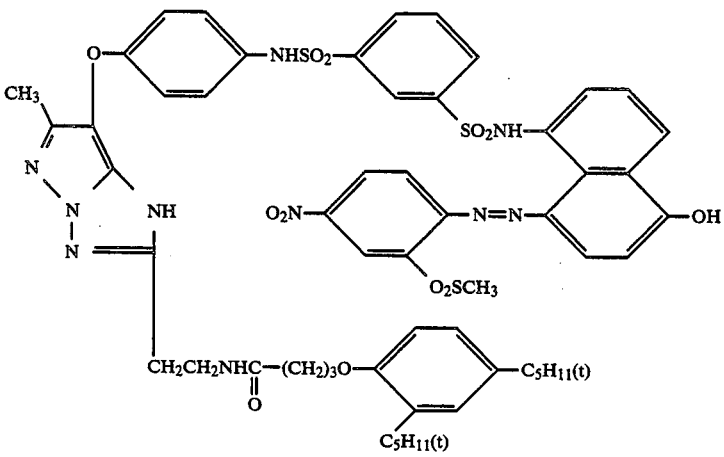

[FORMULATION]

Sixth layer
- gelatin (coating weight 800 mg/m$^2$)
- hardener*6 (coating weight 100 mg/m$^2$)
- silica*5 (coating weight 100 mg/m$^2$)
- basic zinc carbonate (coating weight 200 mg/m$^2$)

Fifth layer: Blue-sensitive emulsion layer
- silver iodobromide emulsion (iodine 5 mol %, coating weight 400 mg/m$^2$ of Ag)
- silver benzotriazole emulsion (coating weight 100 mg/m$^2$ of Ag)
- 2,6-dichloro-p-aminophenol (coating weight 78 mg/m$^2$)
- yellow dye-providing substance (X) (coating weight 440 mg/m$^2$)
- gelatin (coating weight 1000 mg/m$^2$)
- high-boiling solvent*4 (coating weight 220 mg/m$^2$)
- surface-active agent*2 (coating weight 100 mg/m$^2$)

Fourth layer: Intermediate layer gelatin (coating weight 800 mg/m$^2$)
basic zinc carbonate (coating weight 200 mg/m$^2$)

Third layer: Green-sensitive emulsion layer
silver chlorobromide emulsion (bromine 80 mol %, coating weight 300 mg/m$^2$ of Ag)
silver benzotriazole emulsion (coating weight 100 mg/m2 of Ag)
2,6-dichloro-p-aminophenol (coating weight 58 mg/m$^2$)
magenta dye-providing substance (Y) (coating weight 400 mg/m$^2$)
gelatin (coating weight 1000 mg/m$^2$)
high-boiling solvent*1 (coating weight 200 mg/m$^2$)
surface-active agent*2 (coating weight 100 mg/m$^2$)

Second layer: Intermediate layer
gelatin (coating weight 800 mg/m$^2$)
basic zinc carbonate (coating weight 200 mg/m$^2$)

First layer: Red-sensitive emulsion layer
silver chlorobromide emulsion (bromine 80 mol %, coating weight 300 mg/m$^2$ of Ag)
silver benzotriazole emulsion (coating weight 100 mg/m$^2$ of Ag)
sensitizing dye*3 (coating weight $8\times10^{-7}$ mol/m$^2$)
2,6-dichloro-p-aminophenol (coating weight 46 mg/m$^2$)
cyan dye-providing substance (Z) (coating weight 300 mg/m$^2$)
glatin (coating weight 1000 mg/m$^2$)
high-boiling solvent*4 (coating weight 150 mg/m$^2$)
surface-active agent*2 (coating weight 100 mg/m$^2$)

Support

*1 tricresyl phosphate

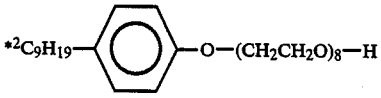

*3

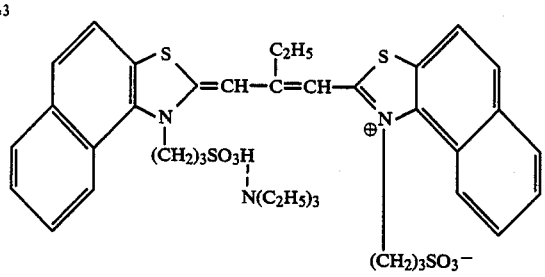

*4 (iso-$C_9H_{19}O)_3P{=}O$

*5 size 4 μm

*6 1,2-bis(vinylsulfonylacetamide)ethane

Another color photosensitive material No. 502 was prepared by the same procedure as above except that Compound (50) of the present invention was added to each of the second and fourth layers as a gelatin dispersion in an amount of 100 grams per square meter.

A gelatin dispersion of Compound (50) of the present invention was prepared by adding 5 grams of Compound (50) and 2.5 grams of triisononyl phosphate to 20 ml of ethyl acetate and heating the mixture at about 60° C. into a solution. The solution was combined and agitated with 50 grams of a 10% lime-treated gelatin solution and 0.5 grams of aerosol OT. The mixture was then dispersed with a homogenizer for 10 minutes at 8,000 rpm.

The dye-fixing material used is K-1 used in Example 1.

The photosentive material Nos. 501 and 502 were treated in combination with dye-fixing material K-1 by the same procedure as in Example 3. Material No. 502 falling with the scope of the invention produced clear images of cyan, magenta, and yellow dyes whereas material No. 501 falling outside the scope of the invention produced turbid images of cyan, magenta, and yellow dyes. It is evident that the compound of the present invention has the benefit of preventing color turbidity.

EXAMPLE 6

Gelatin dispersions were prepared using the same dye-providing substances (A), (B), and (C) as in Example 1.

A solution was prepared by weighing 5 grams of yellow dye-providing substance (A), 2.5 grams of triisononyl phosphate, 160 mg of Compound (50) of the present invention, and 160 mg of an antifoggant*3, adding them to 30 ml of ethyl acetate, and heating the mixture at about 60° C. into a homogeneous solution. The solution was combined and agitated with 100 grams of a 10% lime-treated gelatin solution and 1.0 gram of sodium dodecylbenzenesulfonate, and the mixture was dispersed with a homogenizer for 10 minutes at 10,000 rpm. This dispersion is called yellow dye-providing substance dispersion.

Magenta and cyan dye-providing substance dispersions were prepared by the same procedure as above.

A color photosensitive material No. 601 of multilayer structure as shown in the following formulation was prepared using these dye-providing substance dispersions, and the same emulsions and sensitizing dyes as used in Example 4.

[FORMULATION]

Seventh layer: Protective layer
gelatin (coating weight 350 mg/m$^2$)
silica*6 (coating weight 100 mg/m$^2$)
zinc hydroxide*5 (coating weight 300 mg/m$^2$)

Sixth layer: Protective layer
gelatin (coating weight 500 mg/m$^2$)
hardener*2 (coating weight 10 mg/m$^2$)

Fifth layer: Green-sensitive emulsion layer
silver chlorobromide emulsion (bromine 50 mol %, coating weight 500 mg/m$^2$ of Ag)
silver acetylene emulsion (coating weight 100 mg/m$^2$ of Ag)
sensitizing dye D-1 (coating weight $10^{-6}$ mol/m$^2$)
hardener*2 (coating weight 16 mg/m$^2$)
yellow dye-providing substance (A) (coating weight 400 mg/m$^2$)
antifoggant*3 (coating weight 13 mg/m$^2$)
compound (50) (coating weight 13 mg/m$^2$)
gelatin (coating weight 1000 mg/m$^2$)
high-boiling solvent *1 (coating weight 200 mg/m$^2$)
surface-active agent*4 (coating weight 100 mg/m$^2$)

Fourth layer: Intermediate layer
gelatin (coating weight 700 mg/m$^2$)
hardener*2 (coating weight 18 mg/m$^2$)
zinc hydroxide*5 (coating weight 300 mg/m$^2$)

Third layer: Red-sensitive emulsion layer
silver chlorobromide emulsion (bromine 80 mol %, coating weight 400 mg/m$^2$ of Ag)

silver acetylene emulsion (coating weight 100 mg/m$^2$ of Ag)
sensitizing dye D-2 (coating weight $8\times10^{-7}$ mol/m$^2$)
hardener*2 (coating weight 18 mg/m$^2$)
magenta dye-providing substance (B) (coating weight 400 mg/m$^2$)
antifoggant*3 (coating weight 13 mg/m$^2$)
compound (50) (coating weight 13 mg/m$^2$)
gelatin (coating weight 1000 mg/m$^2$)
high-boiling solvent*1 (coating weight 200 mg/m$^2$)
surface-active agent*4 (coating weight 100 mg/m$^2$)

Second layer: Intermediate layer
gelatin (coating weight 800 mg/m$^2$)
hardener*2 (coating weight 16 mg/m$^2$)
zinc hydroxide*5 (coating weight 300 mg/m$^2$)

First layer: Infrared-sensitive emulsion layer
silver chlorobromide emulsion (bromine 50 mol %, coating weight 300 mg/m$^2$ of Ag)
silver acetylene emulsion (coating weight 80 mg/m$^2$ of Ag)
sensitizing dye D-3 (coating weight $10^{-7}$ mol m$^2$)
hardener*2 (coating weight 16 mg/m$^2$)
cyan dye-providing substance (C) (coating weight 300 mg/m$^2$)
antifoggant*3 (coating weight 10 mg/m$^2$)
compound (50) (coating weight 10 mg/m$^2$)
gelatin (coating weight 1000 mg/m$^2$)
high-boiling solvent*1 (coating weight 150 mg/m$^2$)
surface-active agent*4 (coating weight 100 mg/m$^2$)

Support

*1 triisononyl phosphate
*2 1,2-bis(vinylsulfonylacetamide)ethane

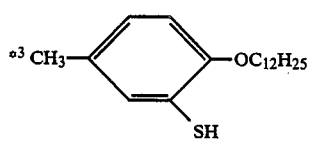

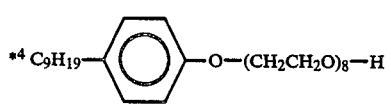

*5 average size 0.3 μm
*6 average size 4 μm

Another color photosensitive material No. 602 was prepared by the same procedure as above using the same formulation except that the gelatin dispersion of Compound (50) of the present invention prepared in Example 5 was further added to the sixth or protective layer.

The dye-fixing material used is K-1 prepared in Example 1.

The photosentive material Nos. 601 and 602 were treated in combination with dye-fixing material K-1 by the same procedure as in Example 1. The results are shown in Table 5.

Table 5 also reports the results obtained from the same photosensitive materials which were shelf stored for 1 month at 40° C. and 70% RH prior to processing in the same manner as above.

TABLE 5

| Photosensitive material No. | | 601 | 602 |
|---|---|---|---|
| Immediately after preparation | | | |
| Maximum density | Yellow | 2.08 | 2.06 |
| | Magenta | 2.29 | 2.30 |
| | Cyan | 2.41 | 2.39 |
| Minimum density | Yellow | 0.13 | 0.13 |
| | Magenta | 0.13 | 0.12 |
| | Cyan | 0.11 | 0.11 |
| Shelf aged at 40° C., 70% RH for 1 month | | | |
| Maximum density | Yellow | 2.07 | 2.07 |
| | Magenta | 2.26 | 2.28 |
| | Cyan | 2.40 | 2.39 |
| Minimum density | Yellow | 0.20 | 0.15 |
| | Magenta | 0.21 | 0.15 |
| | Cyan | 0.22 | 0.14 |

As evident from Table 5, the shelf stability of photosensitive material is further improved by adding the compound of the present invention to a photo-insensitive layer disposed above the remotest silver halide emulsion layer from the support.

EXAMPLE 7

Silver halide emulsions used in first, third, and fifth layers were the same as in Example 3.

Organic silver salts were prepared as follows.

Organic silver salt (1)

A silver benzotriazole emulsion was prepared by dissolving 28 grams of gelatin and 13.2 grams of benzotriazole in 300 ml of water. The resulting solution was agitated at 40° C. A solution of 17 grams silver nitrate in 100 ml water was added to the solution over a period of 2 minutes.

The resulting silver benzotriazole emulsion was adjusted to such pH that an excess salt precipitated, and the excess salt was filtered off. The emulsion was then adjusted to pH 6.30, obtaining a silver benzotriazole emulsion in a yield of 400 grams.

Organic silver salt (2)

In 1000 ml of a 0.1% sodium hydroxide aqueous solution and 200 ml of ethanol were dissolved 20 grams of gelatin and 5.9 grams of 4-acetylaminophenyl propiolic acid. The solution was agitated at 40° C. To the solution was added a solution of 4.5 grams of silver nitrate in 200 ml of water over 5 minutes.

The resulting dispersion was adjusted to such pH that an excess salt precipitated, and the excess salt was filtered off. The dispersion was then adjusted to pH 6.3, obtaining an organic silver salt (2) dispersion in a yield of 300 grams.

Next, dispersions of yellow, magenta, and cyan dye-providing substances in gelatin were prepared as follows.

A solution was prepared by weighing 5 grams of yellow dye-providing substance (A), 0.2 grams of an antifoggant (E), and 0.5 grams of succinic acid-2-ethylhexyl ester sodium sulfonate and 10 grams of triisononyl phosphate as surface-active agents, dissolving them in 15 ml of ethyl acetate by heating at about 60° C. into a homogeneous solution. The solution was mixed with 40 grams of a 10 wt % lime-treated gelatin solution by agitation, and the mixture was dispersed with a homogenizer for 10 minutes at 10,000 rpm. This dispersion is called yellow dye-providing substance dispersion.

A magenta dye-providing substance dispersion was prepared by the same procedure as above except that a magenta dye-providing substance (B) was used as the dye-providing substance and 2.5 grams of tricresyl phosphate was used as the high boiling solvent.

A cyan dye-providing substance dispersion was prepared by the same procedure as above except that a cyan dye-providing substance (C) was used as the dye-providing ssubstance.

Dye-providing substance (A)

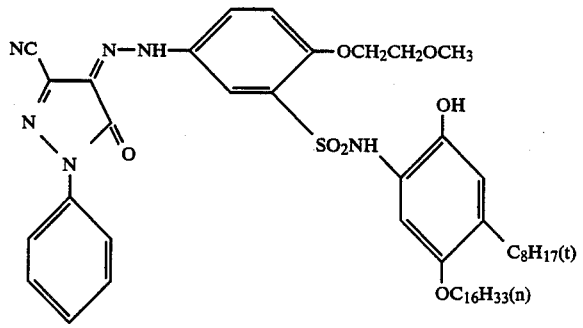

Dye-providing substance (B)

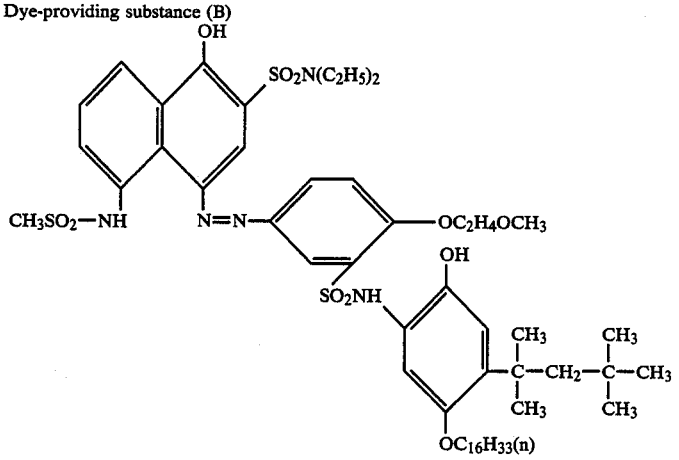

Dye-providing substance (C)

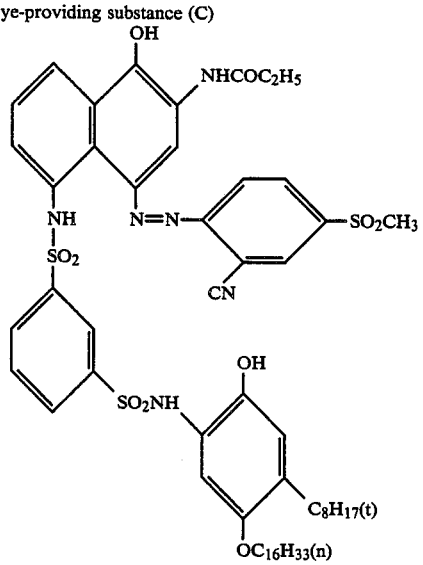

Antifoggant (E)

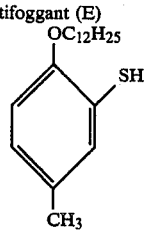

Using these preparations, there was prepared a color light-sensitive material No. 701 of multi-layer structure as shown in the following formulation.

Another color photosensitive material No. 702 having the same formulation as No. 701 was prepared except that 700 mg/m$^2$ of polymer (P-4) of the present invention was added to each of the second, fourth, and sixth layers.

[FORMULATION]

Sixth layer gelatin (coating weight 800 mg/m$^2$)

hardener*6 (coating weight 100 mg/m$^2$)

silica*5 (coating weight 100 mg/m$^2$)

zinc hydroxide*7 (coating weight 300 mg/m$^2$)

Fifth layer: Blue-sensitive emulsion layer silver iodobromide emulsion (iodine 5 mol %, coating weight 400 mg/m² of Ag)
organic silver salt (1) (coating weight 20 mg/m² of Ag)
organic silver salt (2) (coating weight 100 mg/m² of Ag)
yellow dye-providing substance (A) (coating weight 400 mg/m²)
gelatin (coating weight 800 mg/m²)
high-boiling solvent*4 (coating weight 200 mg/m²)
surface-active agent*2 (coating weight 100 mg/m²)
antifoggant (E) (coating weight 16 mg/m²)

Fourth layer: Intermediate layer
gelatin (coating weight 800 mg/m²)
zinc hydroxide*7 (coating weight 300 mg/m²)

Third layer: Green-sensitive emulsion layer
silver chlorobromide emulsion (bromine 80 mol %, coating weight 300 mg/m² of Ag) organic silver salt (2) (coating weight 100 mg/m² of Ag)
magenta dye-providing substance (B) (coating weight 400 mg/m²)
gelatin (coating weight 800 mg/m²)
high-boiling solvent*1 (coating weight 200 mg/m²)
surface-active agent*2 (coating weight 100 mg/m²)
antifoggant (E) (coating weight 16 mg/m²)

Second layer: Intermediate layer
gelatin (coating weight 800 mg/m²)
zinc hydroxide*7 (coating weight 300 mg/m²)

First layer: Red-sensitive emulsion layer
silver chlorobromide emulsion (bromine 80 mol %, coating weight 300 mg/m² of Ag)
organic silver salt (1) (coating weight 20 mg/m² of Ag)
organic silver salt (2) (coating weight 100 mg/m² of Ag)
sensitizing dye*3 (coating weight $8\times10^{-7}$ mol/m²)
cyan dye-providing substance (C) (coating weight 300 mg/m²)
gelatin (coating weight 800 mg/m²)
high-boiling solvent*4 (coating weight 150 mg/m²)
surface-active agent*2 (coating weight 100 mg/m²)
antifoggant (E) (coating weight 12 mg/m²)

Support

*1 tricresyl phosphate

*2 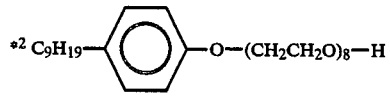

*3

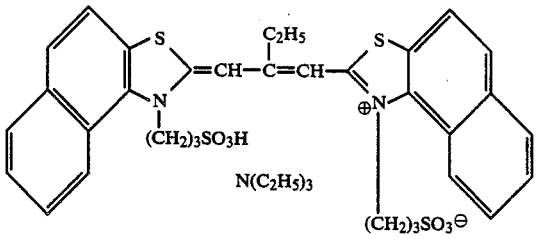

*4 $(iso\text{-}C_9H_{19}O)_3P{=}O$

*5 size 4 μm

*6 1,2-bis(vinylsulfonylacetamide)ethane

*7 size 0.2 μm

Next, the preparation of a dye-fixing material will be described.

Preparation of Dye-Fixing Material

In 1300 ml of water were dissolved 63 grams of gelatin, 130 grams of a polymeric mordant having the structure as defined below, and 80 grams of guanidine picolinate. The resulting mixture was uniformly spread onto a paper substrate laminated with polyethylene, thereby forming a mordant layer having a uniform wet thickness of 45 μm, which was then dried.

Polymer structure:

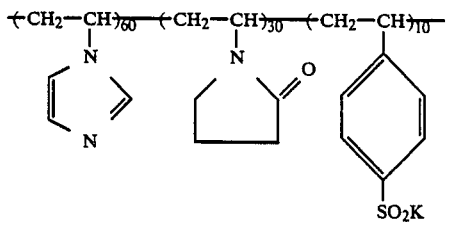

A solution of 35 grams of gelatin and 1.05 grams of 1,2-bis(vinylsulfonylacetamide)ethane in 800 ml of water was uniformly coated on the mordant layer to a wet film thickness of 17 μm. After drying, there was obtained a dye-fixing material.

Multilayered color light-sensitive material Nos. 701–702 were exposed for one second at 2000 lux under a tungsten lamp through three color separation filters B, G, and R having a continuously varying density.

Water was applied by means of a wire bar in an amount of 15 ml per square meter to the emulsion surface of the thus exposed light-sensitive material, which was superimposed on the dye-fixing material such that their effective surfaces faced one another. After heating for 25 seconds through heat rollers at such a temperature that the temperature of the wet film reached 90° C., the dye-fixing material was peeled from the light-sensitive material. The dye-fixing material then bore thereon clear images of yellow (Y), magenta (M), and cyan (C) corresponding to the three color separation filters. The maximum density (Dmax) and minimum density (Dmin) of the respective color images were measured by means of a Macbeth (RD-519) reflection densitometer. The results are shown in Table 6.

Photosensitive material Nos. 701 and 702 were shelf aged for 7 days at 40° C. and 80% RH and then processed in the same manner as above. The maximum and minimum densities associated with these shelf aged materials are also shown in Table 6.

TABLE 6

| Photo-sensitive material | | Immediately after prep. | | Shelf aged @ 40° C. 80% for 1 week | |
|---|---|---|---|---|---|
| | | Dmax | Dmin | Dmax | Dmin |
| 701 | Yellow | 1.98 | 0.14 | 2.01 | 0.19 |
| (comparison) | Magenta | 2.15 | 0.16 | 2.16 | 0.22 |
| | Cyan | 2.40 | 0.17 | 2.38 | 0.25 |
| 702 | Yellow | 1.96 | 0.12 | 1.95 | 0.13 |
| (invention) | Magenta | 2.12 | 0.14 | 2.11 | 0.16 |
| | Cyan | 2.35 | 0.14 | 2.36 | 0.16 |

As seen from Table 6, the polymer according to the present invention is effective in producing images having a high density and less fog as well as in improving the shelf stability of photosensitive material.

EXAMPLE 8

A color photosensitive material No. 801 having a multi-layer structure as formulated below was prepared using the same emulsions as in Example 7.

Dye-providing substances (F), (G), and (H) having the following structures were used instead of dye-providing substances (A), (B), and (C) used in Example 7.

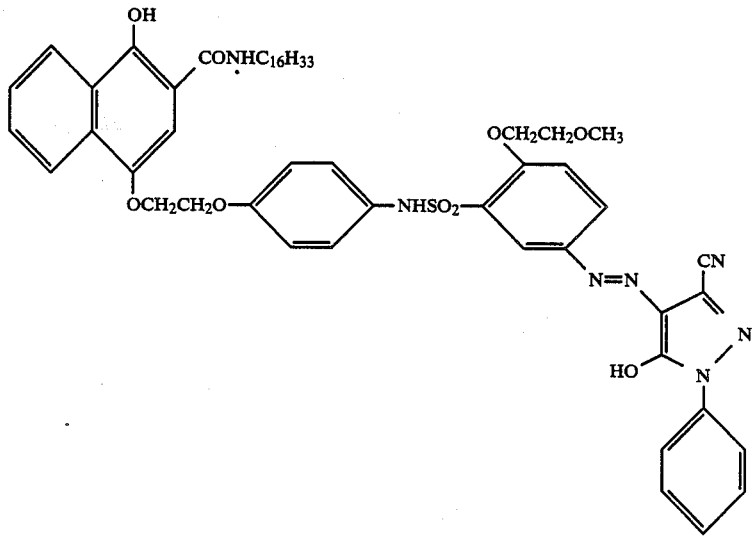

(F)

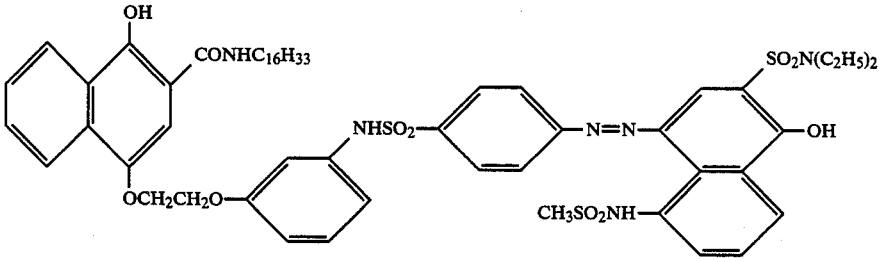

(G)

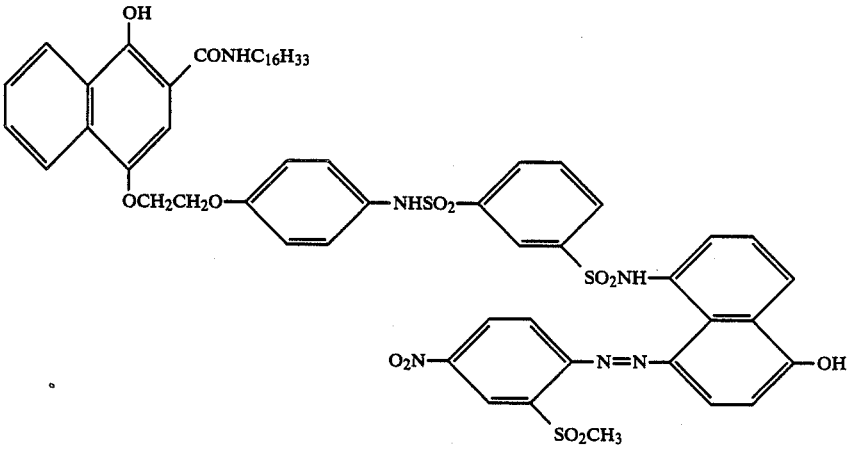

(H)

[FORMULATION]

Sixth layer
- gelatin (coating weight 800 mg/m$^2$)
- hardener*6 (coating weight 100 mg/m$^2$)
- silica*5 (coating weight 100 mg/m$^2$)
- base precursor*7 (coating weight 400 mg/m$^2$)

Fifth layer: Blue-sensitive emulsion layer
- silver iodobromide emulsion (iodine 5 mol %, coating weight 400 mg/m$^2$ of Ag)
- organic silver salt (1) (coating weight 50 mg/m$^2$ of Ag)
- organic silver salt (2) (coating weight 50 mg/m$^2$ of Ag)
- 2,6-dichloro-p-aminophenol (coating weight 78 mg/m$^2$)
- yellow dye-providing substance (F) (coating weight 440 mg/m$^2$)
- gelatin (coating weight 800 mg/m$^2$)
- high-boiling solvent*4 (coating weight 220 mg/m$^2$)
- base precursor*7 (coating weight 350 mg/m$^2$)
- surface-active agent*2 (coating weight 100 mg/m$^2$)
- dimethyl sulfamide (coating weight 150 mg/m$^2$)

Fourth layer: Intermediate layer gelatin (coating weight 800 mg/m²)
base precursor*7 (coating weight 400 mg/m²)

Third layer: Green-sensitive emulsion layer
silver chlorobromide emulsion (bromine 80 mol %, coating weight 300 mg/m² of Ag)
organic silver salt (1) (coating weight 50 mg/m² of Ag)
organic silver salt (2) (coating weight 50 mg/m² of Ag)
2,6-dichloro-p-aminophenol (coating weight 58 mg/m²)
magenta dye-providing substance (G) (coating weight 400 mg/m²)
gelatin (coating weight 800 mg m²)
base precursor*7 (coating weight 350 mg/m²)
dimethyl sulfamide (coating weight 150 mg/m²)
high-boiling solvent*1 (coating weight 200 mg/m²)
surface-active agent*2 (coating weight 100 mg/m²)

Second layer: Intermediate layer
gelatin (coating weight 800 mg/m²)
base precursor*7 (coating weight 400 mg/m²)

First layer: Red-sensitive emulsion layer
silver chlorobromide emulsion (bromine 80 mol %, coating weight 300 mg/m² of Ag)
2,6-dichloro-p-aminophenol (coating weight 46 mg/m²)
organic silver salt (1) (coating weight 50 mg/m² of Ag)
organic silver salt (2) (coating weight 50 mg/m² of Ag)
sensitizing dye*3 (coating weight $8\times10^{-7}$ mol/m²)
cyan dye-providing substance (H) (coating weight 300 mg/m²)
gelatin (coating weight 800 mg/m²)
base precursor*7 (coating weight 350 mg/m²)
high-boiling solvent*4 (coating weight 150 mg/m²)
surface-active agent*2 (coating weight 100 mg/m²)
dimethyl sulfamide (coating weight 150 mg/m²)

Support

*1 tricresyl phosphate

*2 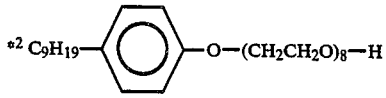

*3

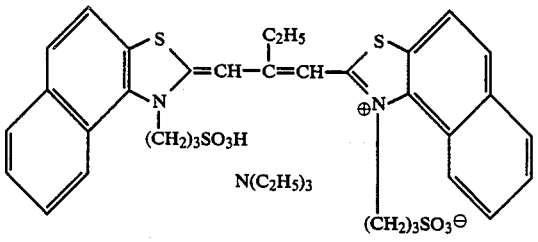

*4 (iso-$C_9H_{19}O)_3P{=}O$

*5 size 4 μm

*6 1,2-bis(vinylsulfonylacetamide)ethane

*7 guanidine p-chlorophenylsulfonylacetate

Additional color photosensitive material Nos. 802 and 803 having the same formulation as No. 801 was prepared except that Polymer (P-5) or (P-8) of the present invention was added to each of the second, fourth, and sixth layers in an amount as shown in Table 7.

A further color photosensitive material No. 804 having the same formulation as No. 801 was prepared except that an equivalent amount of compound (J) of the structure shown below was added to each of the second, fourth, and sixth layers as a dispersion in triisononyl phosphate (100 mg/m²).

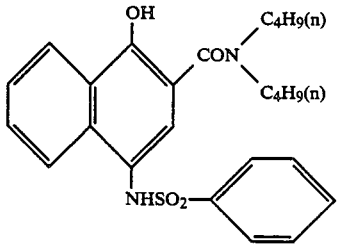

After drying, multilayered color photosensitive material Nos. 801–804 were imagewise exposed for one second at 2000 lux under a tungsten lamp through three color separation filters B, G, and R having a continuously varying density. The exposed materials were uniformly heated on a heating block at 150° C. for 20 seconds.

A dye-fixing material D-2 having an image-receiving layer was prepared.

First, 10 grams of poly(methyl acrylate-co-N,N,N-trimethyl-N-vinylbenzyl ammonium chloride) having a ratio of methyl acrylate to vinylbenzyl ammonium chloride of 1:1 was dissolved in 180 ml of water. The solution was combined with 20 ml of an aqueous solution of 4% 1,4-bis 2',3'-epoxypropoxy)butane hardener and then homogeneously mixed with 100 grams of 10% lime-treated gelatin. The mixture was evenly spread on a paper substrate laminated with polyethylene having titanium dioxide dispersed therein, thereby forming a layer having a uniform wet thickness of 90 μm. Drying resulted in dye-fixing material D-2 having a mordant layer.

Water was applied to the layer surface of dye-fixing material D-2 in an amount of 20 ml per square meter. At the end of heating, the photosensitive material was superimposed on the wet dye-fixing material such that their effective surfaces faced one another. After heating for 6 seconds on a heat block at 80° C., the dye-fixing material was peeled from the photosenstitive material. The dye-fixing material then bore thereon clear images of yellow (Y), magenta (M), and cyan (C) corresponding to the three color separation filters. The maximum and minimum densities of the respective color images were measured by means of a Macbeth (RD-519) reflection densitometer. The results are shown in Table 7.

TABLE 7

| Photosensitive material | Compound No. | Amount* (mg/m²) | | Maximum Density | Minimum Density |
|---|---|---|---|---|---|
| 801 (control) | — | — | Yellow | 1.90 | 0.18 |
| | | | Magenta | 2.10 | 0.20 |
| | | | Cyan | 2.22 | 0.22 |
| 802 | Polymer (P-5) | 780 | Yellow | 1.85 | 0.16 |
| | | | Magenta | 2.06 | 0.15 |
| | | | Cyan | 2.18 | 0.15 |
| 803 | Polymer (P-8) | 600 | Yellow | 1.88 | 0.14 |
| | | | Magenta | 2.08 | 0.16 |
| | | | Cyan | 2.20 | 0.16 |

TABLE 7-continued

| Photosensitive material | Compound No. | Amount* (mg/m²) | | Maximum Density | Minimum Density |
|---|---|---|---|---|---|
| 804 (comparison) | J | 200 | Yellow | 1.46 | 0.25 |
| | | | Magenta | 1.69 | 0.16 |
| | | | Cyan | 1.72 | 0.16 |

Color turbidity was observed in comparative photosensitive material Nos. 801 and 804, but not in photosensitive material Nos. 802 and 803 having added thereto polymers falling within the scope of the present invention. As seen from Table 7, the polymers according to the present invention are effective in producing images having a high density, less fog, and less color turbidity.

We claim:

1. A method for forming an image comprising the steps of:

imagewise exposing a heat-developable photosensitive material comprising, on a support, at least: (1) a photosensitive silver halide, (2) a binder, (3) a dye-providing substance, and (4) an auxiliary developing agent selected from the group consisting of compounds of formula (I), compounds of formula (II) and compounds of formula (III);

heating the photosensitive material in the presence of water and a base and/or a base precursor during or after the imagewise exposing, thereby forming or releasing a diffusible dye; and transferring the dye to a dye-fixing layer to form an image;

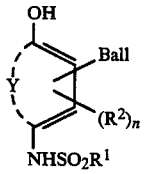

(I)

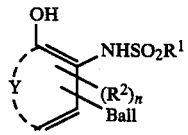

(II)

wherein

Ball represents an organic ballast radical capable of rendering the compounds of these formulas non-diffusible, with the proviso that Ball may be absent when $R^1$ is a non-diffusible radical;

Y represents a group of carbon atoms necessary to complete a benzene or naphthalene nucleus;

$R^1$ is a member having no photographic influence and selected from the group consisting of a substituted or unsubstituted alkyl, cycloalkyl, aralkyl, aryl, amino, and heterocyclic radical;

$R^2$ is selected from the group consisting of hydrogen, a halogen atom, a cyano radical, a substituted or unsubstituted alkyl, cycloalkyl, aralkyl, aryl, heterocyclic, alkoxy, aryloxy, acyl, acyloxy, alkyloxycarbonyl, aryloxycarbonyl, carbamoyl, sulfamoyl, alkylsulfonyl, arylsulfonyl, acylamino, alkylthio, and arylthio radical; and n is an integer having a value of 0 to 5;

wherein when n is 2 to 5, a corresponding plurality of $R^2$ may be the same or different and may be combined together to form a ring, and when Y represents a group of carbon atoms necessary to complete a naphthalene nucleus, Ball and $R^2$ may be attached to either of the thus formed rings;

or high molecular weight compounds comprising monomer units represented by the general formula (III):

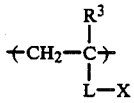

(III)

wherein $R^3$ is selected from the group consisting of hydrogen, halogen, and a lower alkyl radical;

L represents a single bond or a divalent linkage; and

X is a residue of compounds having the general formulas (IV) and (V):

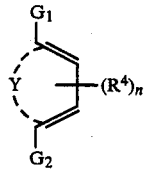

(IV)

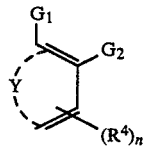

(V)

wherein

Y represents a group of carbon atoms necessary to complete a benzene or naphthalene nucleus;

G1 and G2 are indepenently selected from a hydroxyl radical and a sulfonylamino radical having the general formula (VI):

$$-NHSO_2R^5 \qquad \text{(VI)}$$

wherein $R^5$ is a monovalent radical selected from the group consisting of a substituted or unsubstituted alkyl, cycloalkyl, aralkyl, aryl, amino, and heterocyclic radical, and $R^5$ is a divalent radical selected from the same radicals when $R^5$ is further attached to L; G1 and G2 may be the same of different;

$R^4$ is a monovalent radical selected from the group consisting of hydrogen, a halogen atom, a hydroxyl radical, a cyano radical, a substituted or unsubstituted alkyl, cycloalkyl, aralkyl, aryl, heterocyclic, alkoxy, aryloxy, acyl, acyloxy, alkyloxycarbonyl, aryloxycarbonyl, carbamoyl, sulfamoyl, alkylsulfonyl, arylsulfonyl, acylamino, alkylthio, arylthio, and amino radical, and a sulfonylamino radical having general formula (VI), and $R^4$ is a divalent radical selected from the same radicals except the former four radicals or a single bond when $R^4$ is further attached to L; and n is an integer having a value of 0 to 5;

wherein when n is 2 to 5, a corresponding plurality of $R^4$ may be the same or different and may be combined together to form a ring; and when Y represents a group of carbon atoms necessary to complete a naphthalene nucleus, $R^4$ may be attached to either of the thus formed rings;

L being attached to the X residue at either $R^4$ or $R^5$.

2. The method of claim 1 wherein the dye-providing substance (3) has the form $$(\text{Dye-X})_n\text{-Y} \qquad [\text{L I}]$$

wherein

Dye is selected from the class consisting a dye group, a temporarily wavelength shortened dye group, and a dye precursor group;

X represents a single bond or a connecting linkage;

Y represents a group which, in correspondence or counter-correspondence to photosensitive silver salt having a latent image distributed imagewise, produces a difference in diffusibility of the compound represented by $(\text{Dye-X})_n$-Y or releases Dye, the diffusibility of Dye released being different from that of the compound represented by $(\text{Dye-X})_n$-Y; and n represents an integer of 1 or 2, wherein the Dye-X's may be the same or different when n is equal to 2.

3. The method of claim 1 wherein the dye-providing substance (3) is a non-diffusible, oxidizable substance which conforms to the general formula (A):

$$\text{Ra-x-D} \qquad (\text{A})$$

wherein

Ra represents a reducing substrate capable of being oxidized with the silver halide;

D is an image forming dye moiety; and x is a single bond or a linkage;

and which in oxifdized form, can release a diffusible dye under alkaline developing conditiions.

* * * * *

UNITED STATES PATENT AND TRADEMARK OFFICE

CERTIFICATE OF CORRECTION

PATENT NO. : 4,782,004

DATED : November 1, 1988

INVENTOR(S) : Masashi Takeuchi et al

It is certified that error appears in the above-identified patent and that said Letters Patent is hereby corrected as shown below:

Column 79, line 2, change "form" to -- formula --;
Column 80, line 16, change "oxifdized" to -- oxidized --.

Signed and Sealed this

Eighteenth Day of April, 1989

*Attest:*

DONALD J. QUIGG

*Attesting Officer*

*Commissioner of Patents and Trademarks*